US012262788B2

(12) United States Patent
Ransan

(10) Patent No.: US 12,262,788 B2
(45) Date of Patent: Apr. 1, 2025

(54) BALLET POINTE SHOE

(71) Applicant: Lisias Ransan, Boca Raton, FL (US)

(72) Inventor: Lisias Ransan, Boca Raton, FL (US)

( * ) Notice: Subject to any disclaimer, the term of this patent is extended or adjusted under 35 U.S.C. 154(b) by 291 days.

(21) Appl. No.: 17/236,574

(22) Filed: Apr. 21, 2021

(65) Prior Publication Data

US 2021/0267310 A1 Sep. 2, 2021

Related U.S. Application Data

(63) Continuation of application No. PCT/US2019/058206, filed on Oct. 25, 2019.

(60) Provisional application No. 62/925,729, filed on Oct. 24, 2019, provisional application No. 62/794,589, filed on Jan. 19, 2019, provisional application No. 62/754,105, filed on Nov. 1, 2018, provisional application No. 62/751,243, filed on Oct. 26, 2018.

(51) Int. Cl.

| | |
|---|---|
| ***A43B 13/41*** | (2006.01) |
| ***A43B 5/12*** | (2006.01) |
| ***A43B 23/22*** | (2006.01) |
| *A43B 1/14* | (2006.01) |
| *A43B 13/10* | (2006.01) |
| *A43B 23/08* | (2006.01) |

(52) U.S. Cl.

CPC ..... *A43B 13/41* (2013.01); *A43B 5/12* (2013.01); *A43B 23/22* (2013.01); *A43B 1/14* (2013.01); *A43B 13/10* (2013.01); *A43B 23/081* (2013.01)

(58) Field of Classification Search

CPC ..... A43B 13/41; A43B 5/12; A43B 23/22; A43B 23/081; A43B 1/14; A43B 13/10

USPC ..... 36/108, 8.3, 760, 76 R

See application file for complete search history.

(56) References Cited

U.S. PATENT DOCUMENTS 1,621,455 A 3/1927 Bonaventure
1,689,535 A * 10/1928 Rovick ..... A43B 5/12 36/8.3

(Continued)

FOREIGN PATENT DOCUMENTS

CN 106820415 A 6/1997
CN 201782101 U 4/2011

(Continued)

*Primary Examiner* — Alissa J Tompkins
*Assistant Examiner* — Dakota Marin
(74) *Attorney, Agent, or Firm* — Donald S. Showalter, Esq.; GrayRobinson, P.A.

(57) ABSTRACT

A ballet pointe shoe has an upper in which a shank insert and/or an elastic loop can removably and replaceably installed without even partial deconstruction of the ballet pointe shoe. Embodiments may have an upper including a tunnel which may extend beneath a toe box, the tunnel having a mouth which is accessible via the foot compartment and by way of which a shank insert can be installed, removed or replaced. In some embodiments an elastic loop may be routed under a portion of the shank insert extending from the mouth of the tunnel. In some embodiments the tunnel may penetrate a shank body under which an elastic loop may be routed. A shank insert and/or elastic loop may be selected from sets of ones having different characteristics. In some embodiments the toe box and shank body may be included in a monolithic foot supporting structure. In some embodiments a shank insert and/or toe box may be reshaped at any time.

12 Claims, 28 Drawing Sheets

(56) References Cited

U.S. PATENT DOCUMENTS 1,711,788 A * 5/1929 Incutti ..... A43B 13/37 36/76 R
1,762,161 A * 6/1930 Crocker ..... A43B 23/22 36/76 R
1,927,211 A 9/1933 Harris
1,934,591 A 11/1933 Churchill et al.
2,025,521 A * 12/1935 Moss ..... A43B 23/22 36/76 R
2,118,835 A 5/1938 Capezio
2,487,247 A 11/1949 Kenny
2,810,214 A * 10/1957 Wolfe ..... A43B 5/12 36/8.3
3,191,321 A 6/1965 Brutting
3,257,743 A 6/1966 Closson, Jr.
3,435,544 A 4/1969 Lish
3,785,067 A * 1/1974 Ronci ..... A43B 13/10 36/4
3,797,137 A * 3/1974 Harkness ..... A43B 23/087 36/113
4,026,046 A 5/1977 Clark et al.
4,133,117 A 1/1979 Bradley
4,162,583 A 7/1979 Darrin
4,199,878 A 4/1980 Wossner
4,267,649 A * 5/1981 Smith ..... A43B 3/24 36/11.5
4,453,996 A * 6/1984 Terlizzi, Jr. ..... A43B 5/12 156/227
4,519,148 A * 5/1985 Sisco ..... A43B 5/12 36/165
4,598,485 A 7/1986 Joe et al.
4,656,761 A 4/1987 Lord
4,670,996 A * 6/1987 Dill ..... A43B 21/50 36/41
4,735,003 A 4/1988 Dykeman
RE33,018 E 8/1989 Ostrander
4,901,453 A 2/1990 Gaynor
5,035,069 A * 7/1991 Minden ..... A43B 23/087 36/8.3
5,123,181 A * 6/1992 Rosen ..... A43B 3/26 36/97
5,129,165 A 7/1992 Woodle
5,191,726 A 3/1993 Vallee
5,220,735 A * 6/1993 Raoul-Duval ..... A43B 5/12 36/76 R
5,331,751 A 7/1994 Harwood
5,469,641 A 11/1995 Subotic
5,682,685 A * 11/1997 Terlizzi ..... A43B 5/12 36/31
D388,592 S 1/1998 Minden
5,740,618 A * 4/1998 Minden ..... A43B 5/12 36/71
5,996,257 A * 12/1999 Harrison ..... A43B 13/12 36/77 R
6,705,026 B1 * 3/2004 Arbour ..... A43B 13/189 36/71
6,711,833 B1 3/2004 Ransan
6,718,658 B2 * 4/2004 Karasawa ..... A43B 13/30 36/97
6,810,603 B1 11/2004 Cosentino
6,857,203 B2 2/2005 Minden
6,895,693 B2 5/2005 Baruck
6,928,755 B2 8/2005 Chen et al.
7,028,422 B1 * 4/2006 Lewis ..... A43B 1/0081 36/136
7,096,605 B1 8/2006 Kozo et al.
7,124,519 B2 10/2006 Issler
D535,461 S 1/2007 Wilkenfeld et al.
7,254,904 B2 * 8/2007 Nye ..... A43B 23/08 36/8.3
D559,504 S 1/2008 Wilkenfeld et al.
D591,487 S 5/2009 Comeau
7,690,132 B2 * 4/2010 Wilkenfeld ..... A43B 23/22 36/102
7,707,673 B2 5/2010 Durbin
7,765,718 B2 8/2010 Wilkenfeld
D630,829 S 1/2011 Weisner
7,900,375 B2 * 3/2011 Thoraval ..... A43B 23/087 36/76 R
7,926,203 B2 4/2011 Wilkenfeld
8,051,583 B2 * 11/2011 Roether ..... A43B 13/14 36/76 R
8,127,466 B1 * 3/2012 Raval ..... A43B 7/22 36/9 R
8,186,080 B2 5/2012 Favreau et al.
8,191,285 B2 6/2012 Perron, Jr.
8,201,346 B2 * 6/2012 Darby, II ..... A61F 5/0195 36/76 R
8,479,416 B2 7/2013 Auger et al.
D707,927 S 7/2014 Nataadiningrat et al.
D730,025 S 5/2015 Minden
9,314,068 B2 4/2016 Schmutte
9,414,639 B2 * 8/2016 Heathcote ..... A43B 23/17
9,491,981 B2 11/2016 Suffolk et al.
D781,032 S 3/2017 Gavrieli et al.
D781,035 S 3/2017 Gavrieli et al.
D812,864 S 3/2018 Abramowitz
D841,973 S 5/2019 Small
10,769,963 B2 * 9/2020 Jewelewicz ..... A63B 21/045
11,026,474 B2 * 6/2021 Suffolk ..... A43B 7/1464
11,278,080 B2 * 3/2022 Ransan ..... A43B 23/08
2002/0014023 A1 2/2002 Tolwin et al.
2002/0108270 A1 8/2002 Williams
2004/0093761 A1 5/2004 Nye
2004/0226191 A1 11/2004 Hsieh
2005/0022421 A1 * 2/2005 Bruckner ..... A43B 5/12 36/11
2007/0000149 A1 * 1/2007 Juniman ..... A43C 11/006 36/8.3
2007/0199208 A1 8/2007 Wilkenfeld
2007/0266598 A1 * 11/2007 Pawlus ..... A43B 13/16 36/76 R
2008/0034612 A1 * 2/2008 Palattella ..... A43B 5/12 36/8.3
2008/0127518 A1 6/2008 Byrne et al.
2008/0209761 A1 9/2008 Thorcal
2009/0151200 A1 * 6/2009 Niedermeyer ..... A43B 13/41 36/108
2009/0272009 A1 11/2009 Weisner et al.
2010/0126042 A1 * 5/2010 Wyon ..... A43B 13/16 12/146 D
2010/0146822 A1 6/2010 MacGregor
2010/0281715 A1 11/2010 Cayol et al.
2011/0302806 A1 * 12/2011 Auger ..... A43B 13/40 36/44
2013/0239445 A1 * 9/2013 Cayol ..... A43B 13/141 36/3 R
2014/0033569 A1 2/2014 Davis
2014/0190041 A1 * 7/2014 Wu ..... A43B 13/41 36/25 R
2014/0259774 A1 * 9/2014 Minden ..... A43B 5/12 36/97
2015/0007454 A1 * 1/2015 Swift ..... A43B 7/1495 36/88
2015/0059203 A1 * 3/2015 Xu ..... A43B 13/04 36/44
2015/0173454 A1 6/2015 Perez et al.
2015/0342293 A1 * 12/2015 Hazzouri ..... A43B 5/12 12/142 P
2016/0073725 A1 * 3/2016 Guenoun ..... A43B 21/42 36/100
2017/0215519 A1 * 8/2017 McHugh ..... A43B 5/12
2017/0224055 A1 * 8/2017 Hooper ..... A43B 13/14
2019/0014860 A1 * 1/2019 Pavone ..... A43B 21/39
2020/0253323 A1 * 8/2020 Fox ..... A43B 13/16

(56) References Cited

U.S. PATENT DOCUMENTS

| | | | | |
|---|---|---|---|---|
| 2021/0345728 | A1* | 11/2021 | Fox | A43B 13/141 |
| 2023/0055380 | A1* | 2/2023 | Garcia De Val | A43B 3/24 |

FOREIGN PATENT DOCUMENTS

| | | | |
|---|---|---|---|
| CN | 103005781 | A | 4/2013 |
| EP | 0931469 | A1 | 7/1999 |
| KR | 1018707740000 | A | 6/2018 |
| RU | 2003134643 | A | 12/2004 |
| WO | 2002087374 | A1 | 11/2002 |
| WO | 2007029964 | A1 | 3/2007 |
| WO | 2011 117558 | A1 | 9/2011 |

* cited by examiner

BALLET POINTE SHOE

CROSS-REFERENCE TO RELATED APPLICATIONS

This is a continuation of, and claims priority under 35 U.S.C. § 120 to, International Application No. PCT/US2019/058206 filed Oct. 25, 2019 entitled BALLET POINTE SHOE which designates the United States and at least one other country in addition to the United States and, in turn, claims priority to each of the following U.S. provisional patent applications, for all subject matter in each commonly disclosed herein: U.S. Provisional Patent Application No. 62/751,243 entitled "Foot Supporting Structure and Ballet Pointe Shoe Incorporating Same" filed Oct. 26, 2018; U.S. Provisional Patent Application No. 62/754,105 entitled "Foot Supporting Structure and Ballet Pointe Shoe Incorporating Same" filed Nov. 1, 2018; U.S. Provisional Patent Application No. 62/794,589 entitled "Ballet Pointe Shoe" filed Jan. 19, 2019, and U.S. Provisional Patent Application No. 62/925,729 entitled "Ballet Pointe Shoe" filed Oct. 24, 2019, all of which are commonly owned with the present application.

STATEMENT REGARDING FEDERALLY-SPONSORED RESEARCH OR DEVELOPMENT

Not applicable.

INCORPORATION BY REFERENCE

International Application No. PCT/US2019/058206 filed Oct. 25, 2019 entitled BALLET POINTE SHOE, U.S. Provisional Patent Application No. 62/751,243 filed Oct. 26, 2018, U.S. Provisional Patent Application No. 62/754,105 filed Nov. 1, 2018, and U.S. Provisional Patent Application No. 62/794,589 filed Jan. 19, 2019 and U.S. Provisional Patent Application No. 62/925,729 entitled "Ballet Pointe Shoe" filed Oct. 24, 2019, are each expressly incorporated herein by reference in their entireties to form part of the present disclosure.

FIELD OF THE INVENTION

The invention relates to the field of pointe shoes for ballet dancing. More particularly, the invention relates to ballet pointe shoes having an upper which includes a toe box and a tunnel at least a portion of which may extend below the toe box, the tunnel having a mouth which is functionally accessible by way of the foot compartment permitting a shank insert to be removably and replaceably installed by way of the throat of the upper and the mouth of the tunnel. The shank insert and/or an optional elastic loop can be-removed and replaced by way of the foot compartment at any time during the useful life of the ballet pointe shoe without requiring even partial deconstruction of the ballet pointe shoe.

BACKGROUND OF THE INVENTION

The art of ballet dancing is a synthesis of grace, poise and fluidity of motion of the human form. Its mastery requires not only disciplined training but also considerable bodily strength, endurance and athleticism. Albert Einstein once described dancers as "the athletes of God". The physical demands ballet imposes on a performer make it imperative that ballet pointe shoes, fit the dancer very well and provide appropriate support of the foot. Appropriate support is especially important in critical areas of the foot such the toes, the metatarsal region and arch. Good fit and appropriate support not only afford better comfort but also to reduce fatigue and the risk of injury or other maladies which may result from improper form, muscle fatigue, muscle strain, falling or other maladies, all of which can be caused or exacerbated by ill-fitting or improperly supportive ballet pointe shoes. Maladies which commonly afflict ballet dancers include pulled or torn muscles and ligaments, joint damage, sprains and conditions as tendonitis, posterior impingement, flexor hallucis longus tenosynovitis (a/k/a "trigger toe"), posterior compartment syndrome, Achilles tendinopathy, plantar fasciitis and osteoarthritis. All can be painful and may require expensive medical treatment and/or temporary or permanent limitation or cessation of dancing or other physical activities. Some may even end the career of a ballet performer.

In a ballet pointe shoe, the forefoot support provided by the toe box of the shoe and appropriate support of the arch region are always important but especially so when a dancer enters and maintains certain positions or performs certain movements such as eleve' or releve' in which a dancer is supported on the stage or other dance floor on their toes and the heel of the foot is elevated above the stage or dance floor. The elevation of the heel is increased further when a dancer assumes a "demi-pointe" and further yet when fully "en pointe" where the dancer is supported on the very tips of the toes. In such movements, the toe box of a ballet pointe shoe may bear substantially all of the weight the dancer. A ballet pointe shoe, and especially its toe box may also be subjected to impact forces or other dynamic forces not only when the performer is in such extreme postures but also in the process of assuming or transitioning out of such postures.

A typical ballet pointe shoe has an upper having a toe platform at its front end, a heel adjacent its rear end, a vamp, lateral sides extending between the heel and the vamp, and a throat extending between the vamp and the heel. An insole is typically disposed inside the upper at the bottom of the foot compartment and an outsole is typically secured beneath the upper. The throat is the top opening by way of which a foot of the ballet dancer enters the foot compartment upper when putting on the ballet pointe shoe for use. At least part of the exterior of the upper of a typical ballet pointe shoe has an outer fabric and some or all of the interior of the upper may be lined with an inner liner. The throat is sometimes surrounded by a sewn-on binding strip which is sewn to the outer fabric and inner liner to form a channel inside the binding strip through which all but a pair of extending free ends of a drawstring is routed. To help secure the ballet shoe to the foot of a dancer, the free ends of the drawstring are manually pulled taut to cinch the throat of the ballet pointe shoe to foot of the ballet dancer. Once pulled taut, the free ends of the drawstring are then tied together.

BRIEF SUMMARY OF CERTAIN EMBODIMENTS

Embodiments of a ballet pointe shoe may have an upper which includes a toe box and a tunnel having a mouth. At least a portion of the tunnel may extend below the toe box and the mouth of the tunnel may be functionally accessible by way of the foot compartment to permit a shank insert to be removably and replaceably installed by way of the throat of the upper and the mouth of the tunnel. In preferred embodiments, a monolithic foot-supporting structure may include the toe box and a shank body which extends longitudinally rearward from a base of the toe box. The toe box may have peripheral wall which adjoins its base such that the peripheral wall and base together form cavity at the front of the foot compartment. The peripheral wall of the toe box may include a front wall having an outer surface which may be disposed behind the platform. The shank body and the base of the toe box underlie and support at least a portion of the sole of the foot of the ballet dancer. In some embodiments the sole of the foot of the ballet dancer, including the heel of the foot may be supported by way of an insole overlying the shank body and the base of the toe box.

Some preferred embodiments include an optional shank insert installed in the ballet pointe shoe in a manually removable and replaceable manner. To accommodate a shank insert, at least a portion of the shank body of the monolithic foot-supporting structure may be penetrated by a tunnel which extends in a longitudinal direction and has an open mouth disposed on the shank body.

In some preferred embodiments, the mouth of the tunnel is accessible by way of the foot compartment to permit a shank insert to easily be installed, removed and/or replaced at any time during the useful life of the ballet pointe shoe without using tools and/or even partially deconstructing the ballet pointe shoe. In some embodiments, a shank insert may be installed by way of the foot compartment by inserting at least a portion of the shank insert into the tunnel by way of the mouth of the tunnel. In some of such embodiments, the shank insert may be inserted into the mouth of the tunnel by way of the throat of the ballet pointe shoe. Likewise, a shank insert may be removed by way of the foot compartment of certain embodiments of a ballet pointe shoe. In some embodiments, a shank insert may be withdrawn from the foot compartment by way of the throat. In some of such embodiments, the shank insert may be withdrawn from the tunnel by way of the mouth of the tunnel and may be withdrawn from the ballet pointe shoe by way of the throat of the upper. Accordingly, a shank insert to be installed inserted, removed and/or removed and replaced with the same shank insert or a different one at any time during the useful life of the ballet pointe shoe without using tools and/or deconstructing ballet pointe shoe 20. Such embodiments not only provide a ballet dancer with the ability to fine tune support and bending characteristics of the ballet point shoe at any time during the useful life but also potentially increases useful life by allowing an old, worn out or broken shank insert to easily be replaced with a new one; all without using tools or even partially deconstructing, or rebuilding the ballet pointe shoe.

In some embodiments, the mouth of the tunnel is revealably concealed beneath the insole and/or a ledge that is present on the shank body and extends rearward of the mouth of the tunnel. In some embodiments, the tunnel extends longitudinally forward from the mouth through at least a portion a portion of the shank body. In some embodiments, the tunnel extends longitudinally forward from the mouth not only through at least a portion of the shank body but also into the base of the toe box. Thus, installing, removing and/or replacing a shank insert can be used to fine tune the support and bending characteristics of the ballet pointe shoe at the base of the toe box as well regions longitudinally rearward of the base of the toe box.

In some embodiments a ballet pointe shoe may have a shank insert selected from a set of shank inserts which includes at least two shank inserts whose respective flexural rigidity profiles are different in one or more respects.

In some embodiments, one or more shank inserts may be formed at least in part of thermoplastic material which can be softened by heating and semi-permanently reshaped at point of sale, point of use or other desired place or time in the course of the useful life of the pointe shoe to suit the needs of a particular use and/or preferences of a particular dancer. Reshaping a shank insert may be useful not only to alter its shape but may also modify its flexural rigidity profile. A shank insert may be one which has been reshaped by, for example, heating at least a portion of the shank insert to a temperature which is below the melting temperature of the thermoplastic but is sufficient to cause at least the aforementioned portion of the shank insert to be in a softened state, applying a bending moment to the shank insert when at least that portion of the shank insert is in the softened state to reshape the shank insert from the previous shape into and altered shape and lowering the temperature of at least said portion of the shank insert to a lower temperature at which the altered shape is retained permanently or semi-permanently even in the absence of the bending moment. A shank insert may be one which has been reshaped on one or more prior occasions. For example, a shank insert which has been reshaped from a previous shape into an altered shape may, if desired, be reshaped at any time into a subsequent altered shape.

In some embodiments, at least a portion of the toe box of the monolithic foot-supporting structure may be formed of thermoplastic material and can be reshaped at any time from a previous shape into an altered shape which is different than the previous shape. Reshaping of the toe box may be carried out by, for example, heating at least that portion of the toe box to a temperature which is below the melting temperature of the thermoplastic but is sufficient to cause at least the aforementioned portion of the toe box to be in a softened state, applying a force to the toe box when at least that portion of the toe box is in the softened state to reshape the toe box from the previous shape into the altered shape and lowering the temperature of at least that portion of the toe box to a lower temperature at which the altered shape is retained permanently or semi-permanently even in the absence of the applied force. The shape of the interior cavity of the toe box, and thus, the fit of the ballet pointe shoe may thereby be adjusted or customized to suit the needs or preferences of a particular dancer. Moreover, such reshaping can be carried out once or repeatedly over the useful life of a pointe shoe as the needs of a particular application and/or foot size, foot shape and/or individual preference of a dancer may change from time to time.

In some embodiments, a ballet pointe shoe may optionally include a removable and replaceable elastic loop mounted in the upper for improving retention of the ballet pointe shoe to the foot of a ballet dancer and/or providing enhanced support of the foot. In some embodiments, an elastic loop is mounted removably and replaceably to the upper for continuously urging the shank body toward the sole of the foot of the ballet dancer by continuously applying an elastic force between an instep portion of a foot of the ballet dancer and the shank body of the monolithic foot-supporting structure. To do so, the elastic loop may have a lower portion which is routed beneath the shank body and an upper portion which overlies an instep portion of a foot of the ballet dancer. In some embodiments, the elastic loop is routed for also continuously applying an elastic compressive force to the arch of the foot the ballet dancer.

In some embodiments, a shank insert may be longer than the tunnel present in monolithic foot-supporting structure so that a rear portion of the shank insert extends longitudinally rearward of the mouth of the tunnel when shank insert is installed in the ballet pointe shoe. The lower portion of the elastic loop may be routed beneath the rear portion of the shank insert. This arrangement continuously urges the shank insert toward the sole of the foot of the ballet dancer by continuously applying an elastic force between an instep portion of a foot of the ballet dancer and the shank insert. In some embodiments the shank body may include a ledge which extends longitudinally rearward beyond the mouth of the tunnel and the lower portion of the elastic loop is routed beneath the ledge of the shank body.

In some embodiments the elastic loop may be routed between the shank body and the rear portion of a shank insert. In some such embodiments, a lower portion of the elastic loop may be releasably captured between the ledge of the shank body and the rear portion of the shank insert which extends rearward beyond the mouth of the tunnel. In some of such embodiments, the lower portion of the elastic loop may be releasably captured between the ledge and the rear portion of the shank insert in a manner that permits the elastic loop to be: (i) longitudinally repositioned, or (ii) removed from the ballet pointe shoe, or (ii) removed from the ballet pointe shoe and replaced with a different elastic loop.

In some embodiments, the elastic loop may be one that has been selected from a set of two or more elastic loops. At least one elastic loop in the set differs from at least one other elastic loop in the set with respect to one or more of the following parameters: (i) unstretched width, (ii) unstretched inside circumference, (iii) unstretched thickness, and (iv) spring constant.

Some embodiments not only provide a fitting pointe shoe but also make it possible to provide proper fitting pointe shoes without need to manufacture, ship and/or carry in inventory as many different sizes, widths and/or shapes as would otherwise be required to accommodate a range of different foot sizes, foot widths, foot shapes and individual needs and preferences represented among a diverse population of ballet dancers. In some embodiments a toe box of the ballet pointe shoe and/or an optional removable and replaceable shank inset may be reshaped, either once or repeatedly at any time during the useful life of the ballet pointe shoe. In addition to fine tuning the fit, support and/or bending characteristics of the shoe, this aspect of the invention may eliminate, or at least reduce the need to manufacture, ship and inventory ballet pointe shoes in intermediate shoe sizes such as half-sizes and/or certain shoe widths and/or multiple ones having different integral shanks. In some embodiments, reshaping of the toe box and/or replacing a shank insert and/or the substitution of one shank insert for a different shank insert having a different flexural rigidity profile can be carried out once or repeatedly at any time or place after initial manufacture including without limitation at a store, service center or point of use.

These and other embodiments of the invention are described in further detail below with reference to the drawings in which like reference numerals designate like items. In the detailed description, reference is made to the drawings that are briefly described below wherein like reference numerals designate like items. The drawings show of non-limiting illustrations of some embodiments that may be practiced within the scope of the claims. It is to be understood that other embodiments may be implemented and that various structural, procedural other changes may be made without departing from the scope of the invention.

DETAILED DESCRIPTION OF PREFERRED EMBODIMENTS

Figure 1:
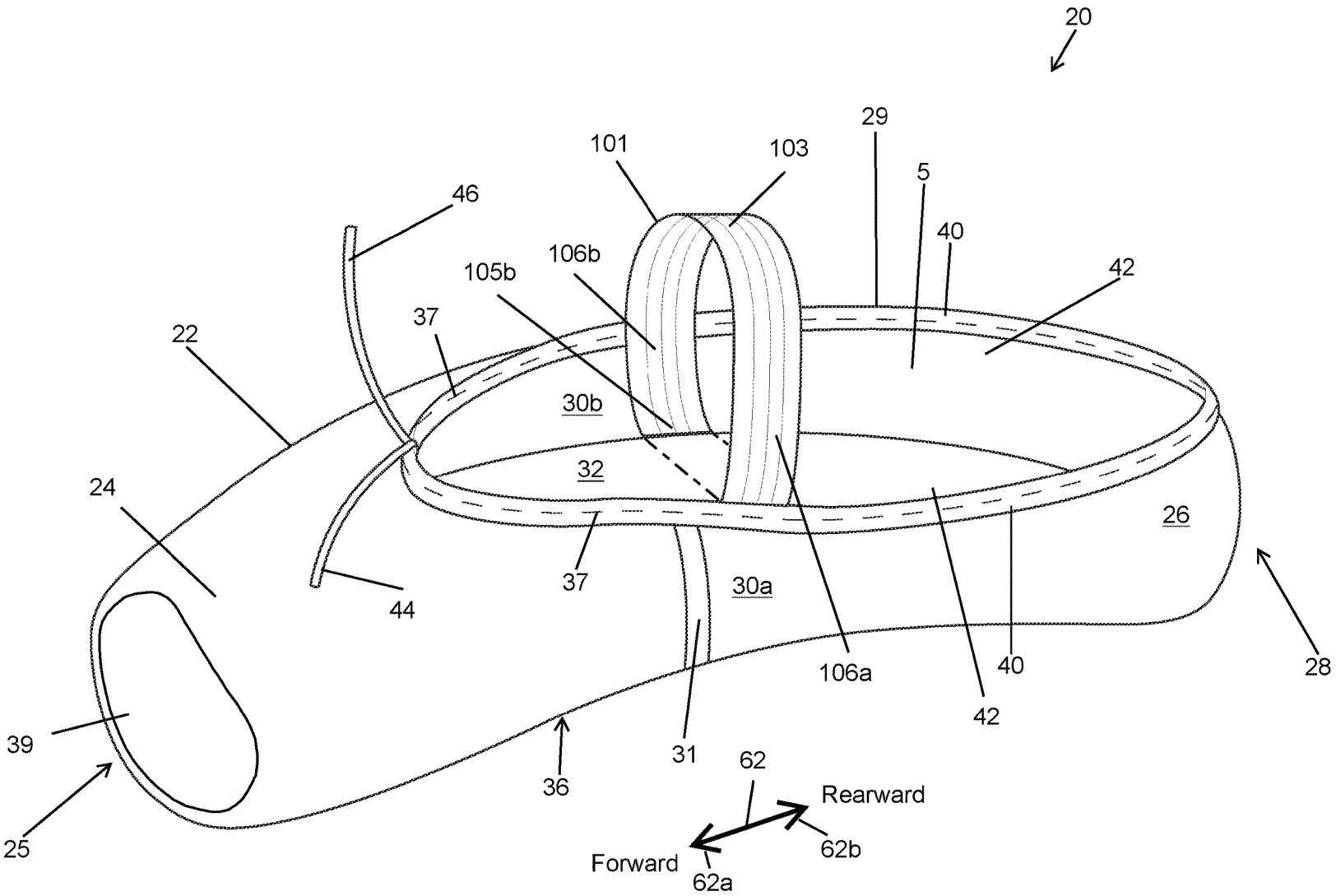
FIG. 1 is a perspective view of an embodiment of a ballet pointe shoe with an optional removable and replaceable elastic loop installed shown therein.

FIGS. 1, 2, 3, 4A and 4B show a non-limiting example of an embodiment of a ballet pointe shoe 20. For convenience, some aspects of an embodiment may be described herein with reference to an imaginary longitudinal axis 49 which may extend in a longitudinal direction 62. The imaginary longitudinal axis 49 may, but need not necessarily, represent an axis of symmetry of a ballet pointe shoe 20.

A ballet pointe shoe 20 may include an upper 22 having an outer fabric 6 and an inner liner 7. The upper 22 has a platform 39 at its front end 25, a heel 26 adjacent its rear end 28, a vamp 24, and lateral sides 30*a* and 30*b* extending in a longitudinal direction 62 between the vamp 24 and heel 26. The upper 22 has an open throat 27 by way of which a foot 41 of a ballet dancer enters the foot compartment 5 of the ballet pointe shoe 20. Some embodiments of a ballet pointe shoe 20 include an outsole 34 disposed beneath the upper 22 on the underside 36 of the ballet pointe shoe 20 and an insole 32 disposed within the foot compartment 5.

In some embodiments, the lateral sides 30*a* and 30*b* of the upper 22 may optionally include lateral seams 31*a* and 31*b*. The outer fabric 6 and/or inner liner 7 may optionally be joined at a heel seam 31*c* which, in some embodiments, may optionally include an external binding strip 33 attached to the heel 26. In some embodiments, all or at least a portion of the upper 22 is covered by an outer fabric 6 and all or at least a portion of the interior of the upper 22 is lined with an inner liner 7.

Figure 2:
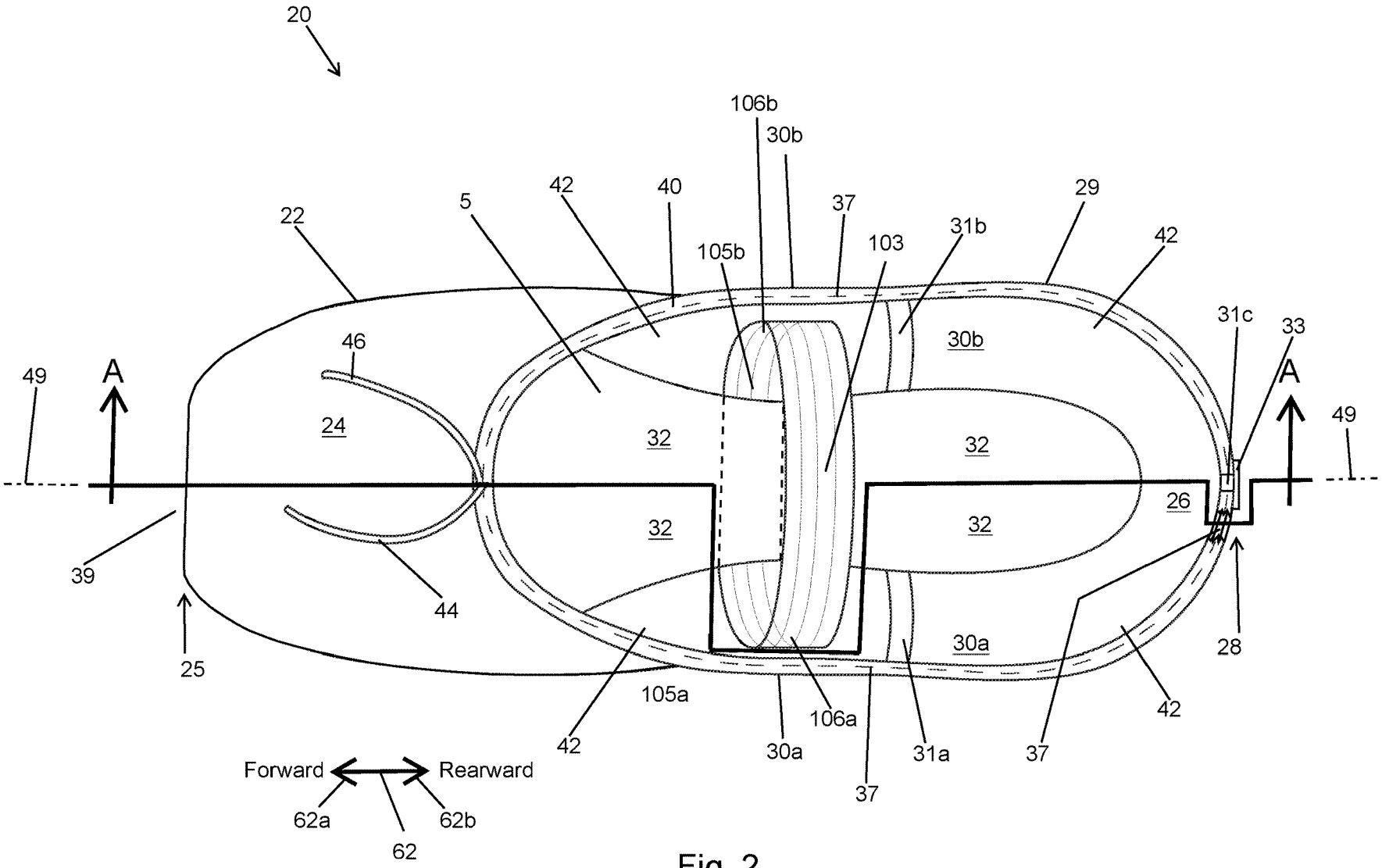
FIG. 2 is a top plan view of the embodiment of FIG. 1.
Figure 3:
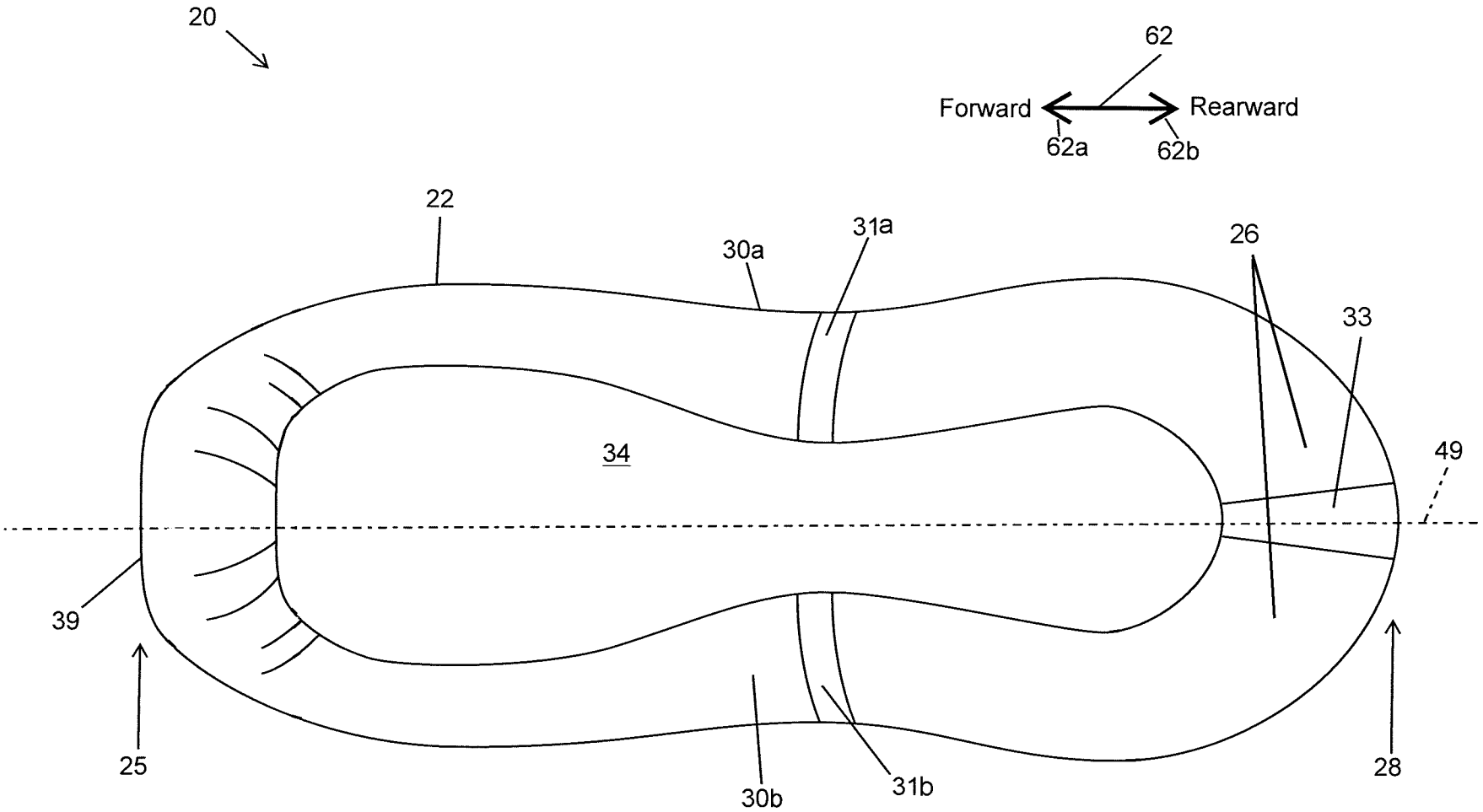
FIG. 3 is a bottom plan view of the embodiment of FIGS. 1 and 2.

In some embodiments, the outer fabric 6 and inner liner 7 may be joined to one another along a throat seam 29 which may run peripherally of the throat 27. In some embodiments, the throat seam 29 may optionally include an external binding strip 35 that may be folded lengthwise and sewn to the outer fabric 6 and/or inner liner 7 in a manner which forms a passage 40 inside the binding strip 35. To help secure the ballet pointe shoe to the foot 41 of a ballet dancer, some embodiments may optionally include a drawstring 37 surrounding the throat 27. In FIG. 2, a portion of the binding strip 35 of the throat seam 29 is shown partially cut away in the vicinity of the heel 26 to reveal the drawstring 37. The drawstring 37 may have free ends 44 and 46 extending from the passage 40 to permit the drawstring 37 to be cinched and tied or otherwise fastened to one another for use. The free ends 44 and 46 of the drawstring 37 may be manually pulled taut and tied to one another to cinch the throat 27 of the ballet pointe shoe to foot 41 of the ballet dancer.

The outer fabric 6 and inner liner 7 may be made of any one or more suitable natural and/or synthetic materials. Outer fabric 6 and inner liner 7 each may have one or more layers. In some embodiments, the outer fabric 6 may be a fabric of silk satin and/or a synthetic satin or a fabric having an exterior face of a satin. In some embodiments, the outer fabric 6 may consist of, or may include, one or more layers of a fabric such as canvas or twill. The inner liner 7 in some embodiments may consist of, or may include, one or more layers of a woven or nonwoven fabric and/or a natural or synthetic leather or suede.

Insole 32 may be formed of one or more layers of any suitable material or materials. In some embodiments insole 34 may include, or optionally be formed entirely of, more layers 11 of leather, suede, foam, fabric or any other one or more other suitable natural and/or synthetic material or combination of materials. The insole 32 may optionally include, or be formed entirely of, one or more layers 10 of resilient foam and/or other cushioning material to provide improved comfort and cushion the foot 41 of a ballet dancer against impact forces. In some embodiments, layer 11 may be a top layer of the insole 32 and may consist of, or be faced with, a natural or simulated leather or suede. The top layer 11 of some embodiments may be of a material of the same type as the inner liner 7 or of a material which substantially visually matches or complements, the color and/or surface finish of the inner liner 7. In some embodiments, a layer 10 of resilient foam and/or other cushioning materials may underlie layer 10 and the layers 10 and 11 of insole 32 may optionally be bonded to one another.

The outsole 34 may be formed of one or more layers of any suitable material or materials. In some embodiments, outsole 34 is made of one or more layers of a natural or synthetic leather or suede material. Outsole 34 may be joined to the upper 22 by adhesive bonding, solvent bonding, thermal fusion bonding, ultrasonic welding, stitching or any other manner suitable for the materials used. The outsole 34 in some embodiments may optionally be an outsole of a type commonly referred to in the art as a "split sole" which has a forefoot section and a heel section which are not directly connected to one another.

Figure 6:
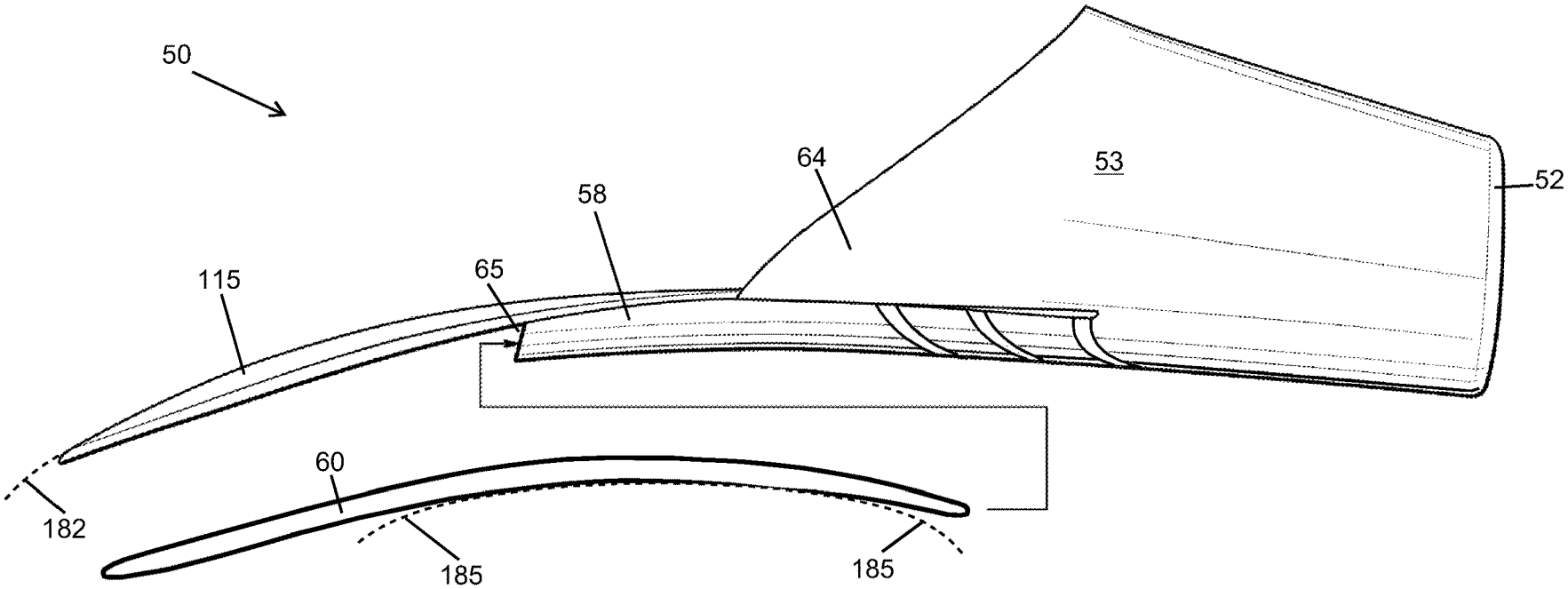
FIG. 6 is a side elevational view of the monolithic foot-supporting structure and shank insert shown in FIG. 5.
Figure 7:
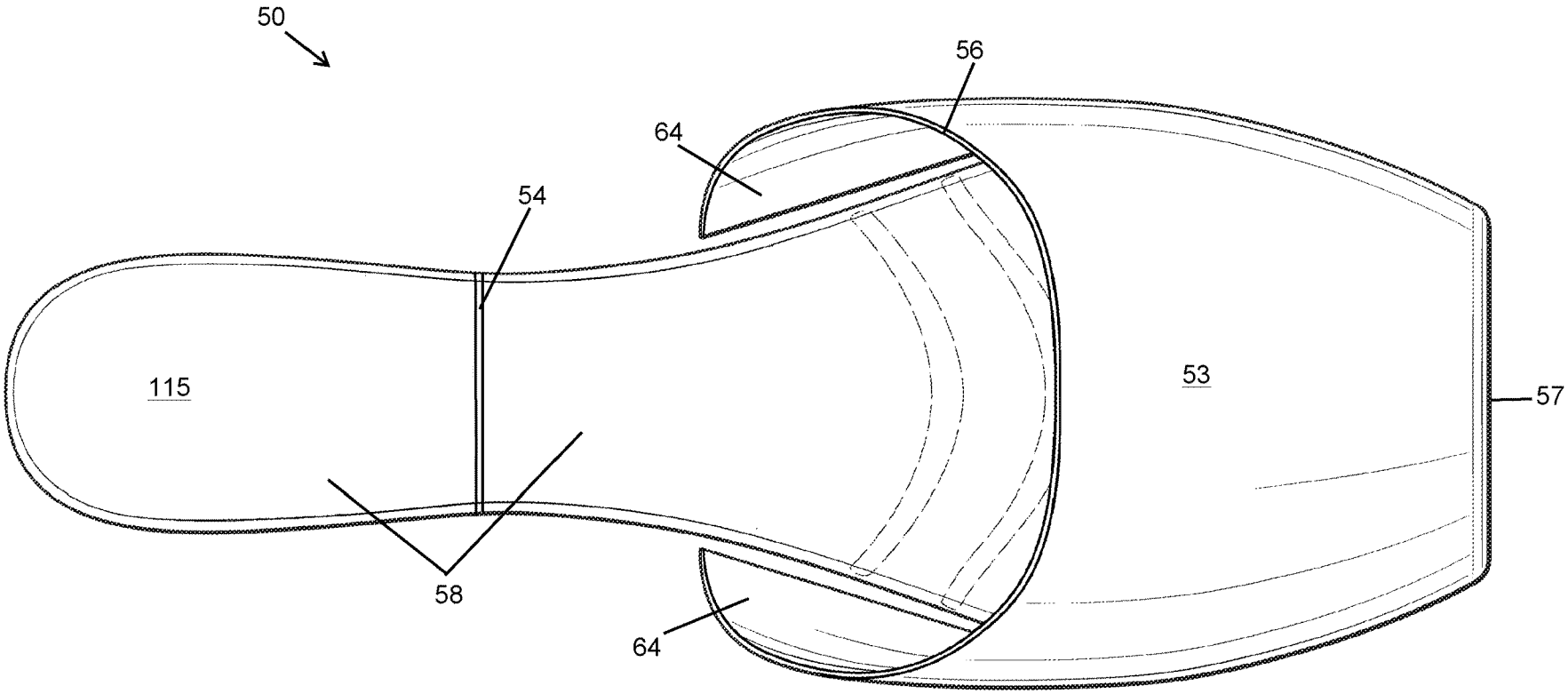
FIG. 7 is top plan view of the monolithic foot-supporting structure shown in FIGS. 5 and 6.
Figure 8:
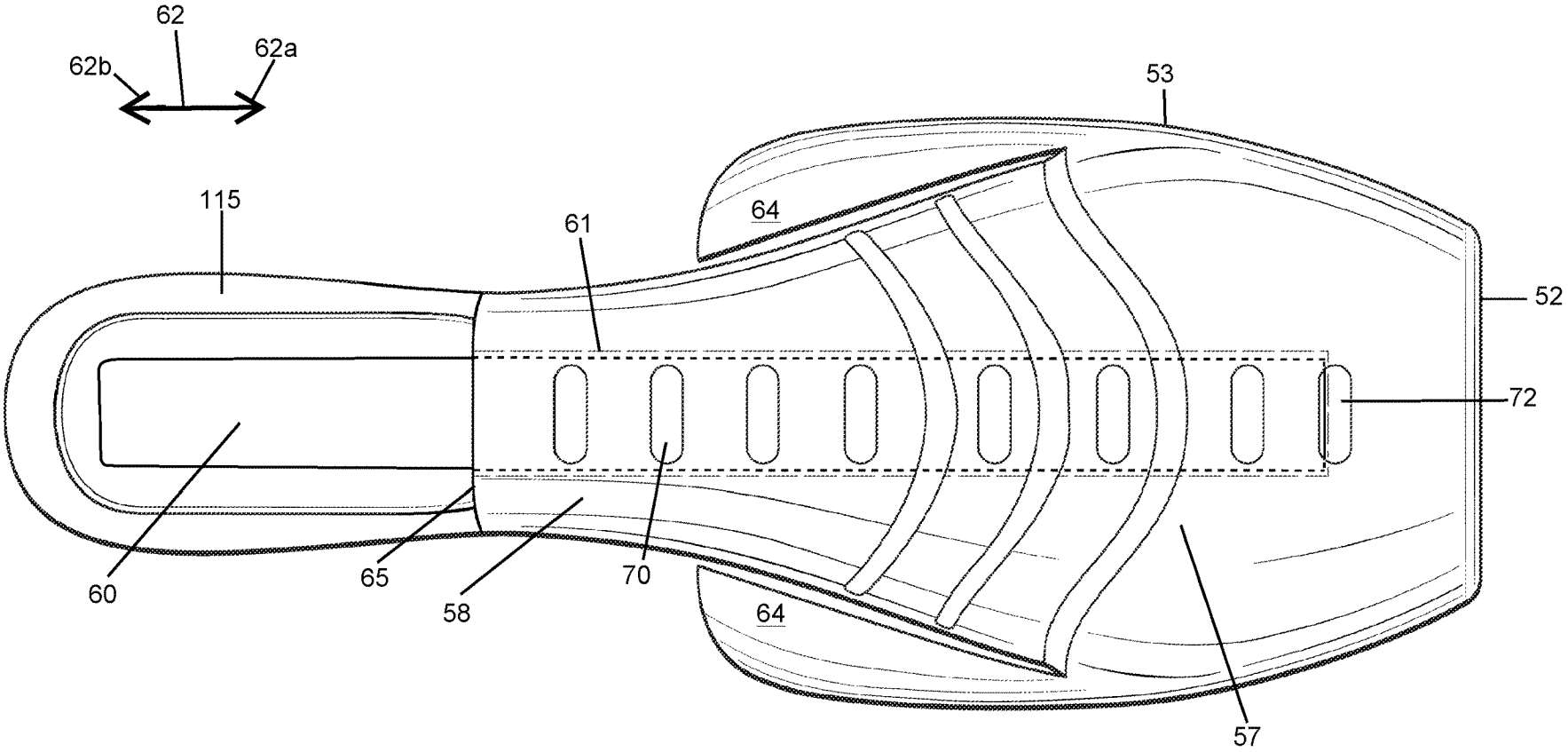
FIG. 8 is a bottom plan view of the monolithic foot-supporting structure shown in FIGS. 5, 6 and 7 but with the shank insert shown installed.
Figure 9:
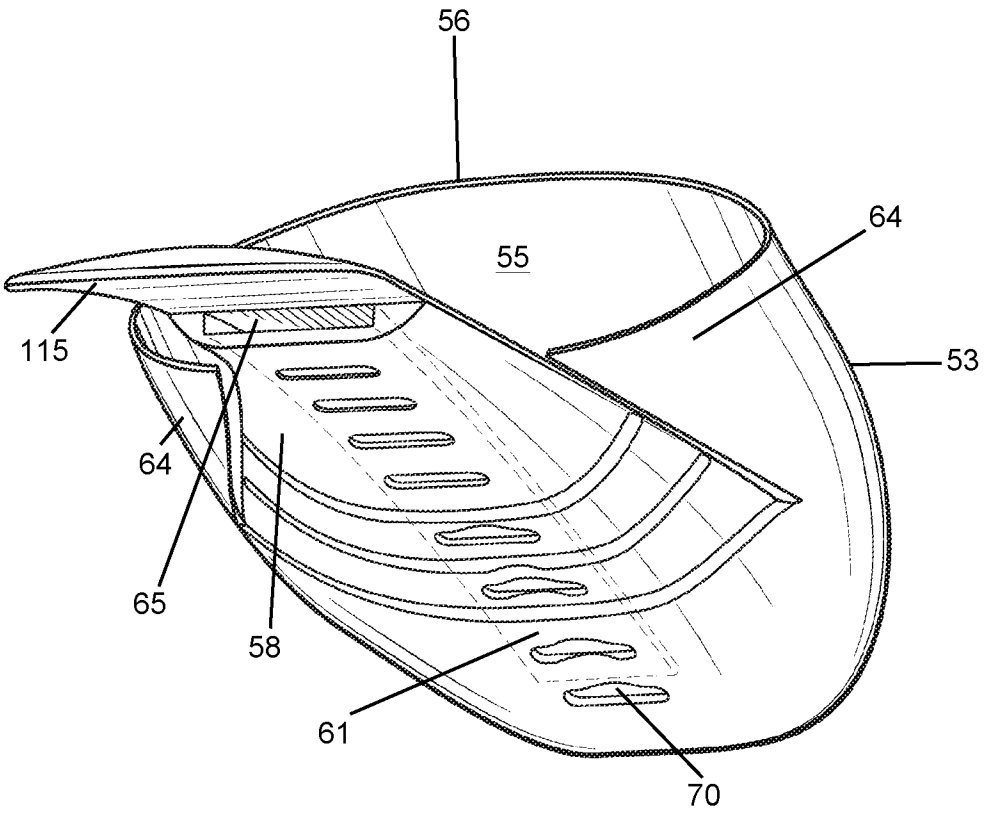
FIG. 9 is an underside perspective view of the monolithic foot-supporting structure shown in FIGS. 5, 6, 7 and 8 but with no shank insert present.

Referring additionally now to FIGS. 7, 8 and 9, the upper 22 of a ballet pointe shoe 20 may include a monolithic foot-supporting structure 50. The monolithic foot-supporting structure 50 includes a toe box 53 having a base 57 and a shank body 58 which extends in a rearward longitudinal direction 62*b* from the base 57 of the toe box 53. The toe box 53 may also include a peripheral wall 56. The peripheral wall 56 may adjoin the base 57 and the peripheral wall 56 and base 57 may form a cavity 55 within which at least a forefoot portion of the foot 41 the ballet dancer may be received during use of the ballet pointe shoe 20. In some embodiments the peripheral wall 56 of the toe box 53 may optionally be completely penetrated by one or more vent openings (not shown) to provide improved ventilation of body heat and moisture and more rapid evaporation of perspiration. In some embodiments, the monolithic foot-supporting structure 50 of ballet pointe shoe 20 may optionally include a pair of gussets 64 which may extend from each lateral side of the toe box 53 to or toward an adjacent side of the shank body 58. In some embodiments, optional gussets 64 may be contiguous with the peripheral wall 56 of the toe box 53. The peripheral wall 56 of toe box 53 may also include a suitably structurally supportive front wall 51 having an outer surface 52. In some embodiments, the outer surface 52 may be substantially planar and front wall 51 may be disposed behind the platform 39 to mechanical support for the platform 39 as is the case in the embodiment illustrated in FIG. 4A. Alternatively, the front wall 51 in some embodiments may itself form all or part of the platform 39. In some embodiments some or all of the upper surface of a shank body 58 may follow a curve 185 as shown in FIG. 6. In some embodiments curve 185 may have a radius in a range extending from about seven inches (7 in.) to about fourteen inches (14 in.).

Figure 4A:
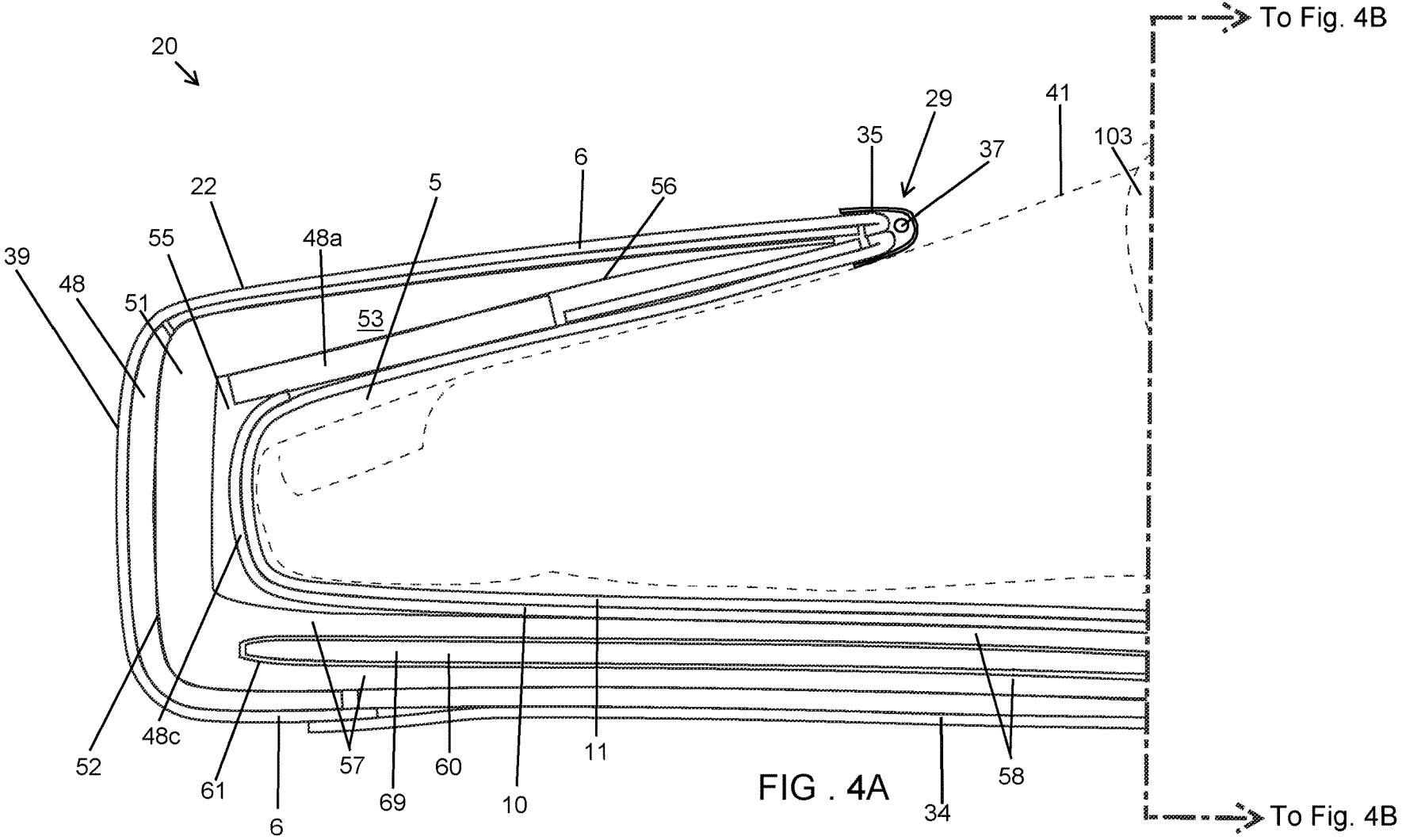
FIG. 4A is a first partial sectional view taken along line A-A of FIG. 2 with the foot of a ballet dancer and an optional elastic shown in phantom lines.

As can be seen for example in FIG. 4A, a monolithic foot-supporting structure 50 in some embodiments may be provided with one or more interior and/or exterior cushioning layers 48 of foam, felt or other cushioning material. In some embodiments a cushioning layer 48 may be overlie all or at least substantial portion of the exterior surface 52 of front wall 51 of the toe box 53 at a location interposed longitudinally between the portion of the outer fabric which covers the platform 39. In addition to cushioning against impact forces during use of ballet pointe shoe 20, a cushioning layer 48 in the location just described also functions as sound-deadening which helps to soften the sound of the platform 39 impacting the floor of a stage or dance studio. In lieu of, or in addition to, the cushioning layer 48 just mentioned, some embodiments may include a second cushioning layer 48*a* at one or more locations between the interior of the toe box 53 wall 56 of cavity 55 and the toes and/or other portions of the foot 41 of a ballet dancer for improved comfort and absorption of impact forces. In some embodiments a third cushioning layer 48*c* may be interposed between the inner liner 7 and the interior of the front wall 51 of the toe box 53. In some embodiments, such cushioning layer 48*c* may be an extension of cushioning layer 48*a* and/or an extension of a cushioning layer 10 of the insole 32. In some embodiments, a cushioning layer 48*a*, 48*b* 48*c* and/or 10 may be interposed between the inner liner 7 and a substantial portion, or all, of the interior cavity 55 of the toe box 53.

As used herein to describe a structure, such as monolithic foot-supporting structure 50, the term "monolithic" refers to a structure formed as a single unit. As the term is used herein, a "monolithic" structure can permissibly be homogeneous but is not required to be homogeneous. A "monolithic" structure may be formed of one material or more than one material. A structure which is formed by casting, injection molding or other molding process is "monolithic" even if it includes one or more molded-in, or cast-in parts which were separate before being incorporated in the molded or cast structure. A "monolithic" structure may permissibly include, but is not required to include, one or more fillers, additives and/or reinforcements or other materials.

In some embodiments all, or at least a portion, of a monolithic foot-supporting structure 50 may be formed of a thermoplastic material. In some embodiments the thermoplastic material may be a thermoplastic elastomer such as thermoplastic polyurethane (TPU) or a thermoplastic polyurethane (TPU) blend. Such a monolithic foot-supporting structure 50 can be made for example by injection molding the shank body 58 and the toe box, including its peripheral wall 56, base 57 and if present, gussets 64, as a unitary molded member. A non-limiting example of one of many suitable thermoplastic materials is a thermoplastic polyurethane which is commercially available under the product name Prismathane® HPU 780A from Prisma Montelur Compostos Termoplastos of Campo Bom, Brazil. In some embodiments, the bottom of the shank body 58 and/or the toe box 53 may optionally include one or more holes 70. Holes 70 may be thru-holes and/or blind holes and may serve to reduce the amount of material required to manufacture monolithic foot-supporting structure 50, reduce its weight and/or to facilitate its manufacture by an injection molding process.

In preferred embodiments, the monolithic foot-supporting structure 50 may include a longitudinal tunnel 61 within which an optional shank insert 60 may be removably and replaceably installed. In some embodiments, the tunnel 61 extends longitudinally through at least a portion of the shank body 58. In certain preferred embodiments, the tunnel 61 extends longitudinally through all, or at least a portion of, the shank body 58 and into at least a portion of the base 57 of the toe box 53 as shown for example in FIGS. 4A and 4B wherein a shank insert 60 shown installed in the tunnel 61. When a shank insert 60 is in an installed state, at least a forward portion 69 of the shank insert 60 is removably and replaceably received in the tunnel 61. In some embodiments, and/or modes of use, an installed shank insert 60 longitudinally spans all or substantially all of the tunnel 61, including without limitation, any portion of the tunnel 61 which extends into the base 57 of the toe box 53. In some other embodiments and/or other modes of use, a shank insert 60 may span only a portion of the longitudinal span of the tunnel 61. It will be understood that even when installed, a shank insert 60 is not itself a part of the monolithic foot-supporting structure 50. A ballet pointe shoe 20, may be used either with or without a shank insert 60 installed therein. In some embodiments, a ballet pointe shoe 20 may include a removable and replaceable a shank insert 60 at least a portion of which may be shaped as a curve 185, one illustrative example of which is illustrated in FIG. 6.

In preferred embodiments, the tunnel 61 has a mouth 65 disposed on the shank body 58 and the mouth 65 of the tunnel 61 is functionally accessible way of the foot compartment 5 to permit insertion and removal for shank insert 60 by way of the foot compartment 5 without using tools and/or even partially deconstructing the ballet pointe shoe 20.

A shank insert 60 is removable from some embodiments of a ballet pointe shoe 20 by withdrawing the shank insert 60 from the tunnel 61 by way of the mouth 65. In preferred embodiments, a shank insert 60 can be withdrawn in a longitudinally rearward direction 62*b* relative to the mouth 65 of the tunnel 61. A shank insert 60 can be installed, or can be replaced with either the same shank insert 60 or a different one, by inserting the shank insert 60 into the tunnel 61 by way of the mouth 65. In preferred embodiments, a shank insert 60 can be installed or replaced by inserting it into the tunnel 61 in a longitudinally forward direction 62*a* relative to the mouth 65 of the tunnel 61.

FIGS. 4A, 4B, 5, 6, 7, 8 and 9 illustrate an embodiment of a ballet pointe shoe 20 in which the shank body 58 of a monolithic foot-supporting structure 50 includes a tunnel 61 having a mouth 65 that is accessible by way of the foot compartment 5. In some such embodiments, the mouth 65 of the tunnel 61 is disposed interiorly of the inner liner 7 as can be seen for example in FIG. 4B. In some embodiments, the shank body 58 may include a ledge 115 that extends longitudinally rearward of the mouth 65 of the tunnel 61 and the mouth 65 of the tunnel 61 may be revealably concealed, at least in part, by and/or beneath the ledge 11S. In such embodiments, functional access to the mouth 65 of the tunnel 61 may be gained by manually bending or pivoting the ledge 115 upward and longitudinally forward to reveal the mouth 65 of the tunnel 61. In some such embodiments, the ledge 115, and any non-removable overlying insole 32 if such an insole 32 is present, are preferably sufficiently flexible to allow such bending or pivoting to take place easily and/or may be hinged for that purpose. For example, FIG. 7 shows a hinge 54 present in shank body 58. Preferably, but not necessarily, a hinge 54 may be positioned at a longitudinal location which is near the longitudinal location of the mouth 65 of tunnel 61 or is longitudinally rearward of the mouth 65 of tunnel 61. In some embodiments, hinge 54 is a live hinge.

In embodiments having an insole 32, the mouth 65 of the tunnel 61 may be revealably concealed beneath the insole 32. In some embodiments, including the embodiments shown in FIGS. 4A and 4B at least a portion of the ledge 115 of the shank body 58 is disposed beneath the insole 32 and the mouth 65 of the tunnel 61 is revealably concealed by both the insole and the ledge 115 of the shank body 58. In some such embodiments where the insole 32 is a removable insole that is capable of being manually removed without even partially deconstructing the ballet pointe shoe 20, the insole 32 may be either removed from the foot compartment 5 or at least lifted up sufficiently to reveal and permit access to the mouth 65 of tunnel 61. In embodiments in which an insole 32 is present but is not a removable insole, the insole 32, may permissibly be glued, sewn or otherwise fastened, either permanently fastened, either permanently or detachably, to the ledge 115 of the shank body 58. However, at least a portion of the insole 32 that longitudinally rearward of mouth 65 is preferably not glued, sewn or otherwise permanently fastened to any structure that would prohibit manual access to the mouth 65 of the tunnel. In preferred embodiments, at least a portion of the insole 32, and ledge 115 if a ledge 115 is present, can be bent or pivoted in the manner described above to reveal and gain access to the mouth 65 of tunnel 61. In some embodiments, the insole 32 may be hinged in the same or similar manner as described above to facilitate such bending and/or pivoting. In some such embodiments, ledge 115 may incorporate a hinge (not shown) similar to hinge 54.

Figure 4B:
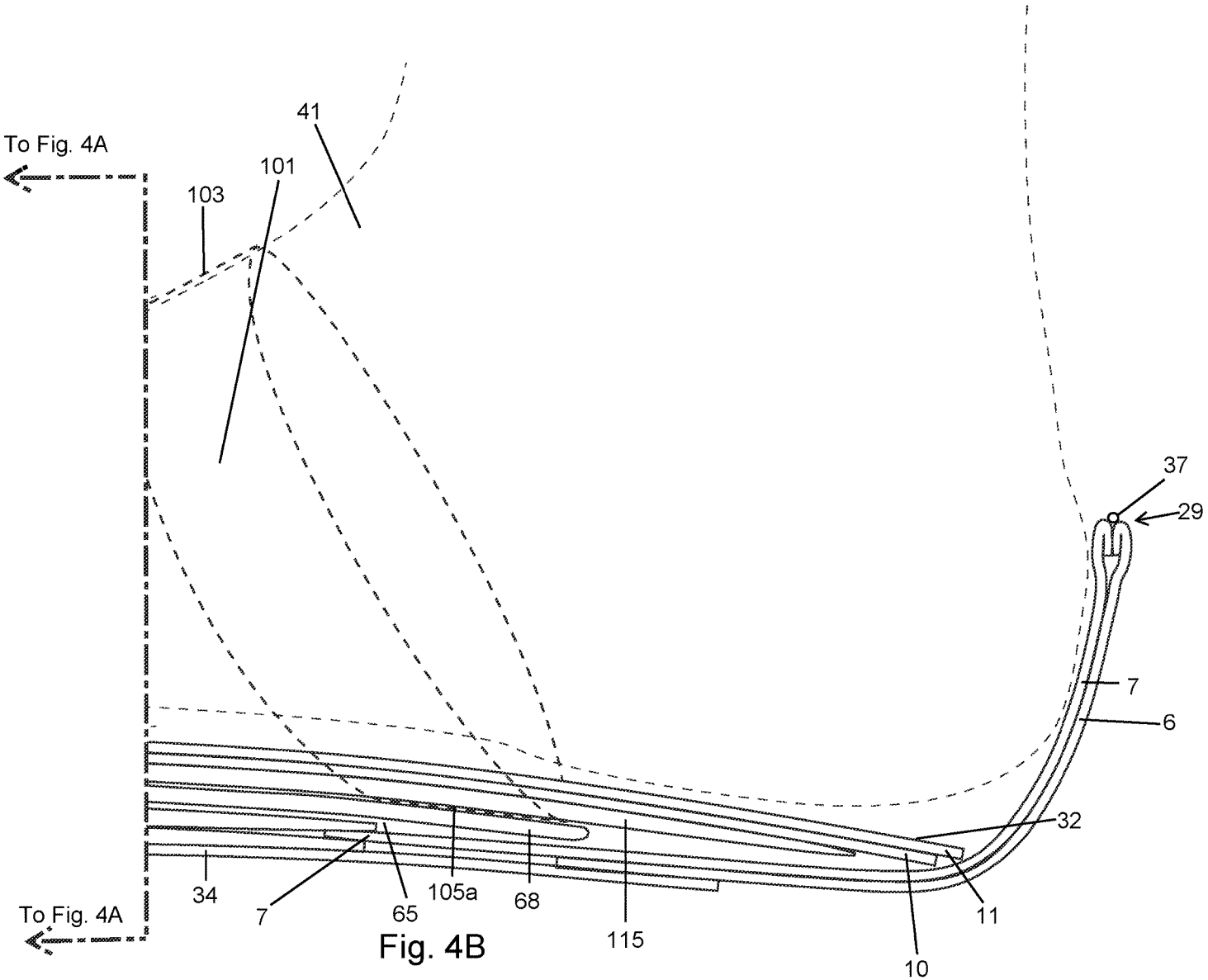
FIG. 4B is a second partial sectional view taken along line A-A of FIG. 2 with foot of a ballet dancer and an optional elastic shown in phantom lines.
Figure 5:
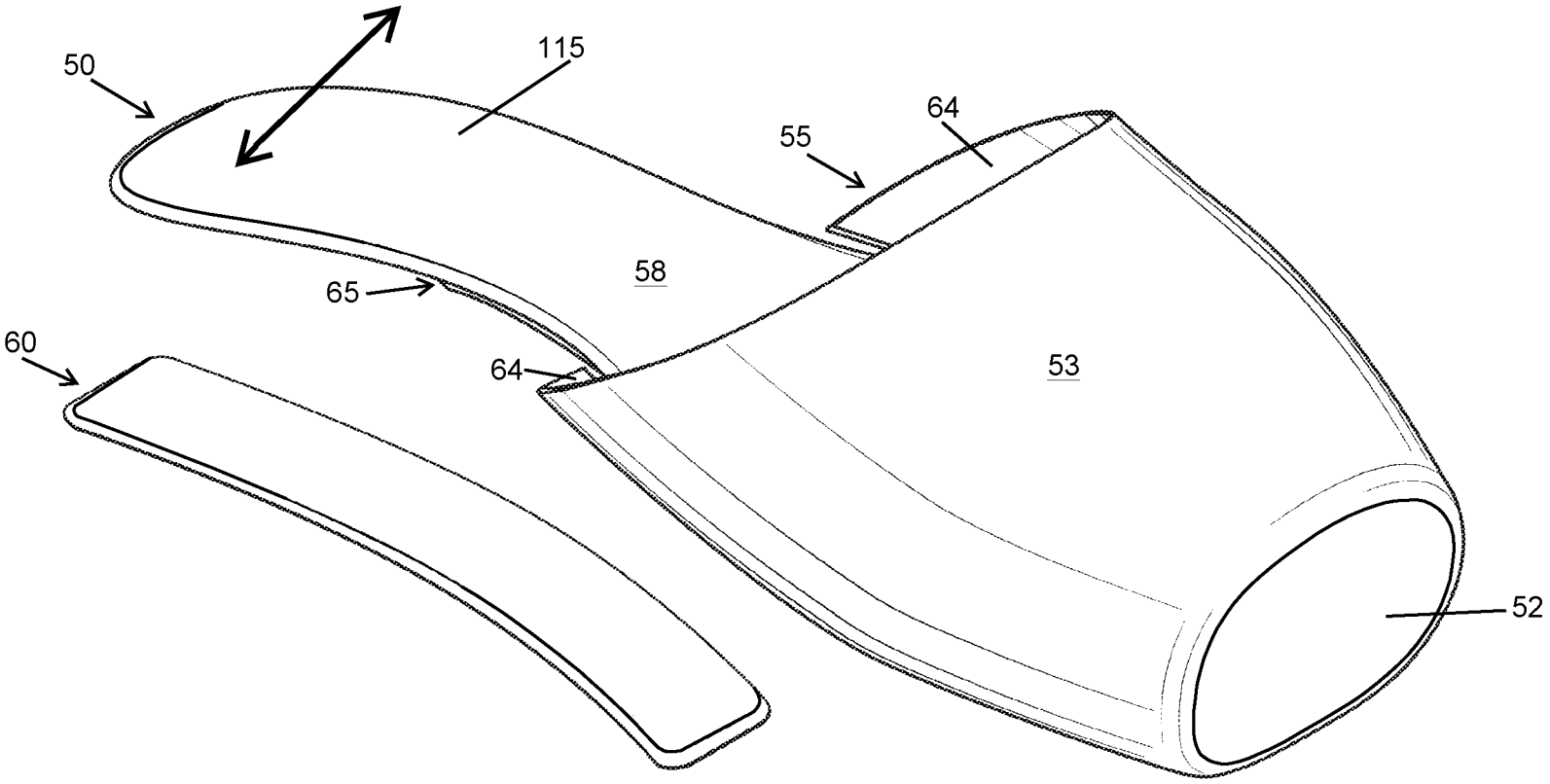
FIG. 5 is a perspective view showing an example of the monolithic foot-supporting structure incorporated in the embodiments of FIGS. 1 through 3, 4A and 4B together with an example of a removable and replaceable shank insert shown therewith but not installed.

It will be understood that in the non-limiting example of FIGS. 4A and 4B, the shank insert 60 shown installed in the tunnel 61 is longer than the tunnel 61 and that the shank insert 60 includes a rear portion 68 that extends longitudinally rearward of the mouth 65 of the tunnel 61.

A shank insert 60 can be installed in ballet pointe shoe 20 by inserting at least a forward portion 69 of the shank insert 60 into the tunnel 61 by way of the throat 27 of the upper 22 and the mouth 65 of the tunnel 61. The shank insert 60 may be removed from the ballet pointe shoe 20 by withdrawing it from the tunnel 61 by way of the mouth 65 of the tunnel 61 and the throat 27 of the upper 22. In preferred embodiments, a shank insert 60 can be withdrawn in a longitudinally rearward direction 62*b* relative to the mouth 65 of the tunnel 61. A shank insert 60 can be installed, or can be replaced with either the same shank insert 60 or a different one, by inserting the shank insert 60 into the tunnel 61 by way of the mouth 65. In preferred embodiments, a shank insert 60 can be installed or replaced by inserting it into the tunnel 61 in a longitudinally forward direction 62*a* relative to the mouth 65 of the tunnel 61.

Referring additionally now to FIGS. 10 through 15, some embodiments of a ballet pointe shoe 20 may have a removable and replaceable shank insert 60 selected from a set 77 of shank inserts 60 in which one or more of the shank inserts 60 in the set 77 have one or more mechanical bending characteristics which differ from those of at least one of the other shank insert 60 in the set 77. From among the shank inserts 60 in a set 77 one, such as a distributor, seller, ballet shoe fitting specialist and/or a ballet dancer, may select a particular shank insert 60 whose length and/or bending characteristics may best suit the needs of a particular use and/or the preferences of a particular ballet dancer. In some embodiments, one or more shank inserts 60 in a given set 77 may have a higher flexural rigidity than one or more other shank inserts 60 in the same set 77 and/or may have a lower flexural rigidity than others in the same set 77. As used herein, the term "flexural rigidity" refers to the resistance offered by a shank insert 60 as it undergoes bending in response to an external load applied in a direction substantially normal to an upper surface 59 of the shank insert 60.

In some embodiments one or more shank inserts 60 in a set 77 may have a flexural rigidity profile which differs from the flexural rigidity profile of one or more other shank inserts 60 in the same set 77. As used herein, the term "flexural rigidity profile" refers to flexural rigidity as a function of position along the length L of a shank insert 60 in the longitudinal direction 62.

In some embodiments a set 77 of shank inserts 60 may include two or more shank inserts 60 whose flexural rigidity profiles differ from one another. In some embodiments, a set 77 may include one or more of the shank inserts 60 having a flexural rigidity profile which is substantially flat, that is, one in which flexural rigidity is substantially constant over its longitudinal length, L. In some embodiments a set 77 include at least two or more shank inserts 60 whose respective flexural rigidities, though both substantially constant, differ from one another in absolute value.

In some embodiments, a set 77 may include two or more shank inserts 60 whose respective flexural rigidity profiles have the same maximum absolute values of flexural rigidity. However, it is preferable for a set 77 to alternatively or additionally include at least two, and most preferably more than two, shank inserts 60 whose respective longitudinal flexural rigidities have respective maximum values that differ from one another in absolute value. In certain embodiments, a set 77 may include two or more shank inserts 60 having respective flexural rigidity profiles in which the minimum absolute value of flexural rigidity for those shank inserts 60 is the same value but it is preferable for a set 77 to alternatively or additionally include at least two, and most preferably more than two, shank inserts 60 whose respective minimum flexural rigidities differ from one another in absolute value. Alternatively or additionally, one or more of the shank inserts 60 in a set 77 may have a flexural rigidity which varies as a function of longitudinal position. For example, the flexural rigidity of a given shank insert 60 at some points or regions along its length in the longitudinal direction 62 may be higher or lower than at other longitudinal points or regions.

Figure 10:
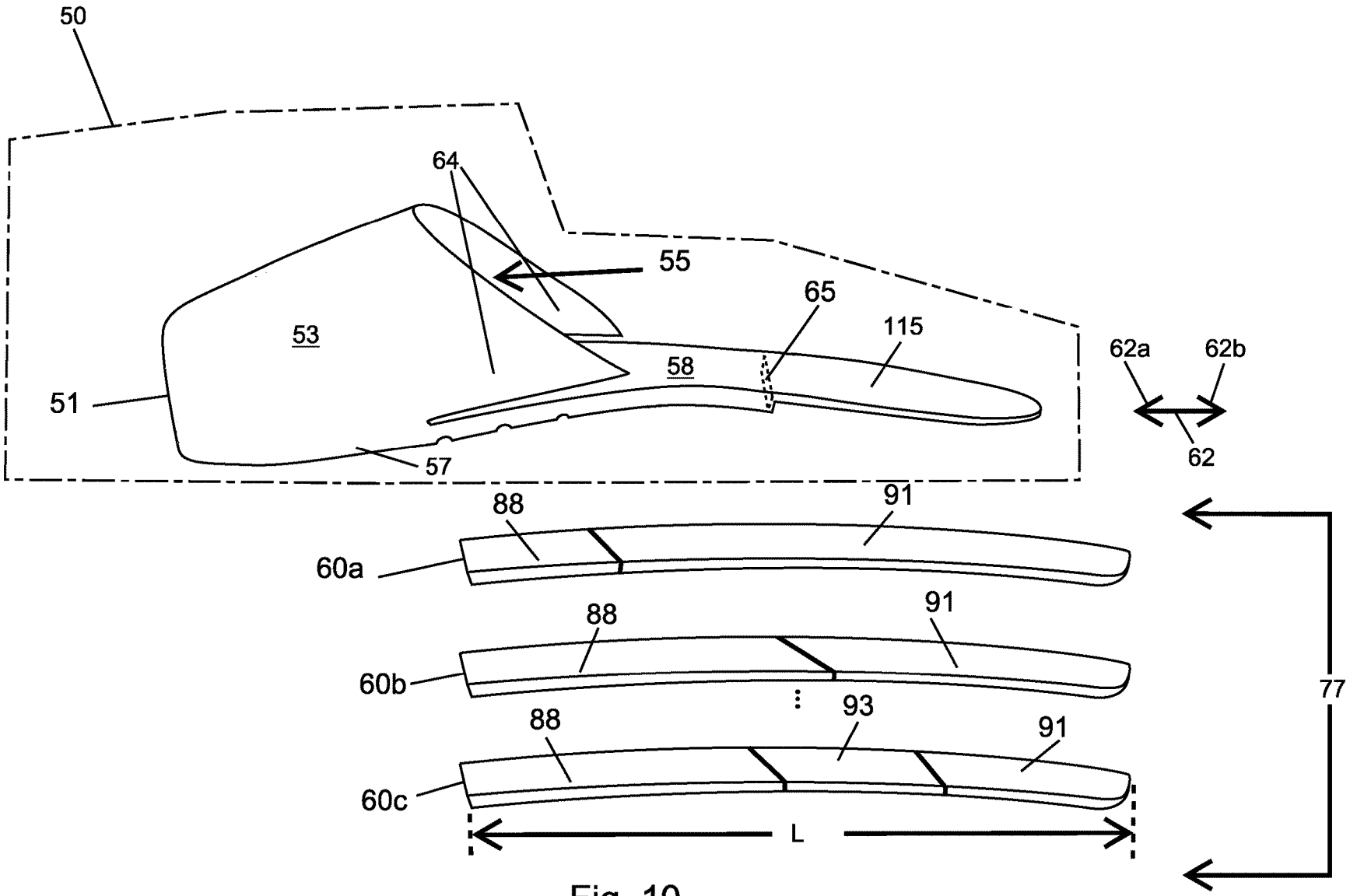
FIG. 10 is a schematic illustration of an embodiment of a monolithic foot-supporting structure shown together with example of a set of shank inserts.
Figure 11:
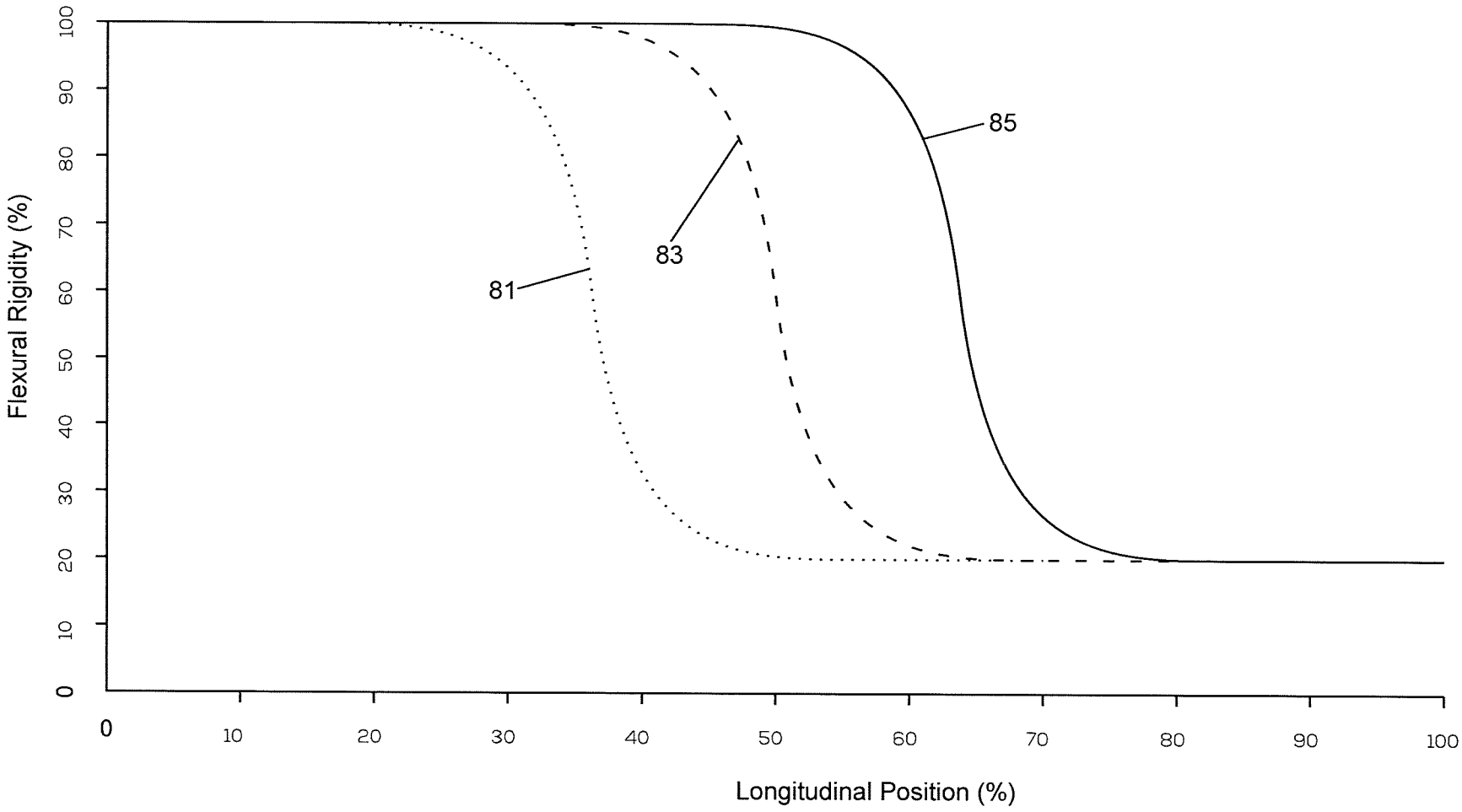
FIG. 11 is a graph illustrating hypothetical examples of the flexural rigidity profiles of the shank inserts shown in FIGS. 10, 12, 13 and 14.

By way of non-limiting hypothetical examples, FIG. 11 shows flexural rigidity profiles 81, 83 and 85 for each of the three shank inserts 60*a*, 60*b* and 60*c* in a set 77 illustrated in FIGS. 10, 12, 13 and 14 respectively. Each of the shank inserts 60*a*, 60*b* and 60*c* in the example set 77 illustrated has an overall length L in the longitudinal direction 62. In the drawings, positions in the longitudinal direction 62 are indicated for convenience of illustration in relative terms as spanning a range extending from zero percent (0%) to one hundred percent (100%) of the overall length, L of a shank insert 60. Likewise, flexural rigidity is also indicated for convenience of illustration in FIG. 11 in relative terms as percentages spanning a range from zero percent (0%) to one hundred percent (100%) of the maximum absolute value present at any longitudinal position along the length L of a shank insert 60. Certain embodiments may include a set 77 of shank inserts which includes at least one, or preferably more than one, shank insert 66 whose maximum and minimum flexural rigidities both differ from the maximum and minimum flexural rigidities of one or more other shank inserts 60 in that same set 77.

As shown in FIGS. 10, 12, 13 and 14, a shank insert 60*a*, 60*b* and 60*c* in a set 77 of shank inserts 60 for a ballet pointe shoe 20 may include at least a first segment 88 and a second segment 91 that are disposed mechanically in series with one another in the longitudinal direction 62. Preferably, the flexural rigidity of the first segment 88 is significantly greater than the flexural rigidity of the second segment 91. In some embodiments the flexural rigidity of the first segment 88 may be at least five percent (5%) greater than, and most preferably at least twenty five percent (25%) greater than, the flexural rigidity of the second segment 91. In certain preferred embodiments, the flexural rigidity of the second segment 91 may be twenty five percent to eighty five percent (25% to 85%) less than the flexural rigidity of the first segment 88. In the non-limiting examples illustrated in FIGS. 10, 12, 13 and 14, the flexural rigidity of each second segment 91 is about eighty percent (80%) less than the flexural rigidity of the first segment 88. Thus, the first segment 88 of each shank insert 60*a*, 60*b*, 60*c* extends in longitudinal direction 62 over a first longitudinal region 89 which has a greater resistance to bending than a second longitudinal region 92 over which its second segment 91 extends.

Figure 12:
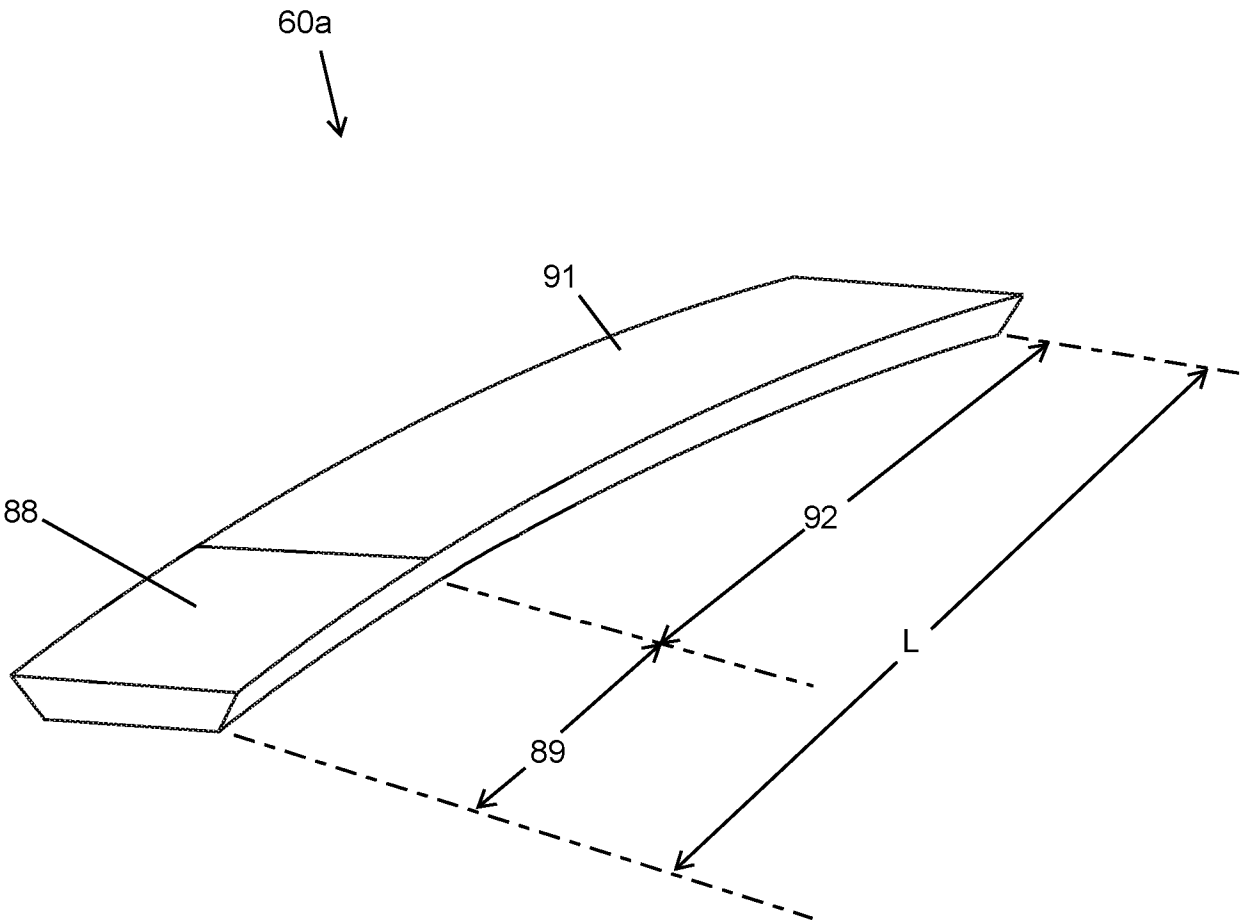
FIG. 12 is a perspective view of a first shank insert having a first flexural rigidity profile.
Figure 13:
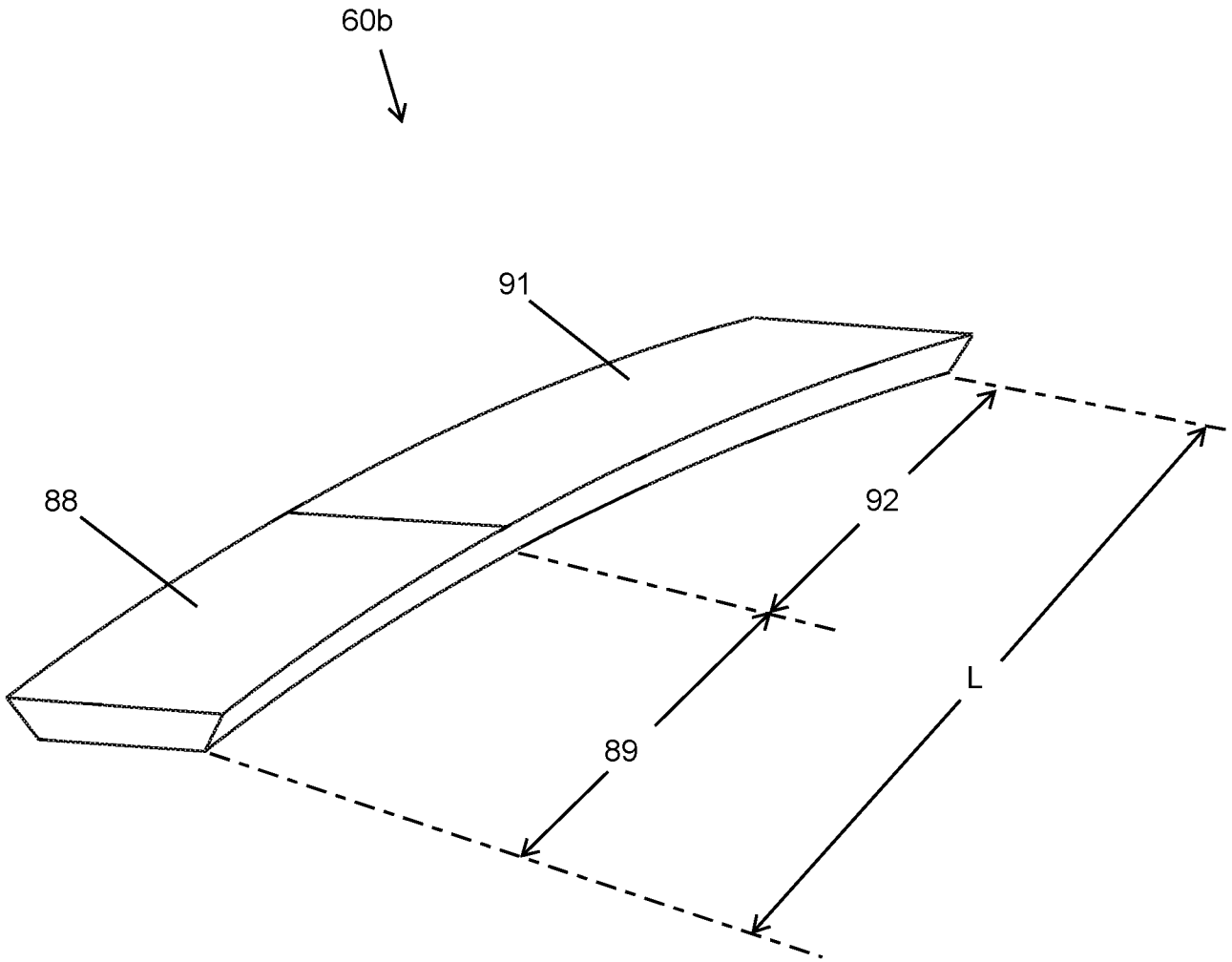
FIG. 13 is a perspective view of a second shank insert having a second flexural rigidity profile.
Figure 14:
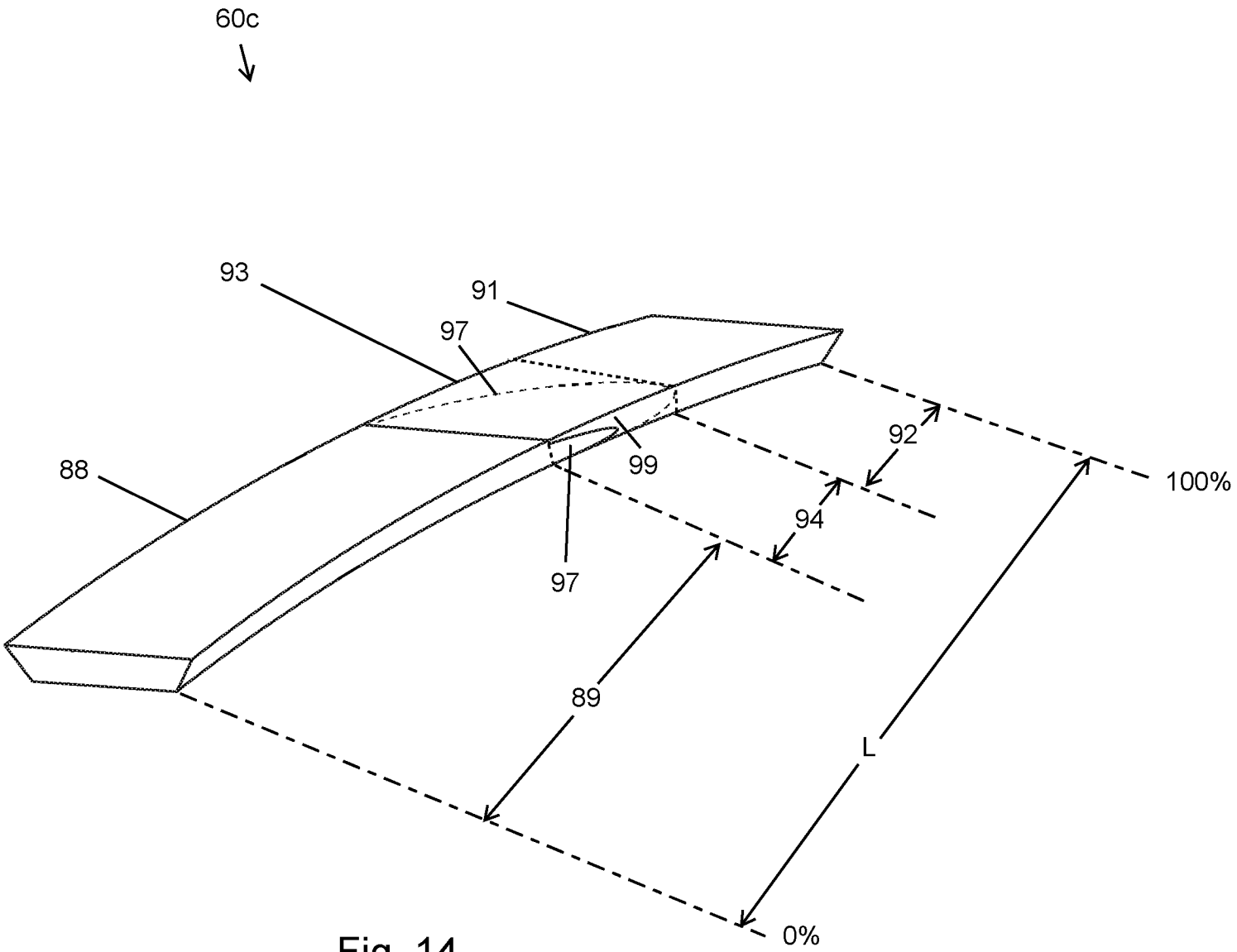
FIG. 14 is a perspective view of a third shank insert having a third flexural rigidity profile.

In some embodiments, such as ones having shank inserts 60*a*, 60*b*, 60*c* as illustrated by FIGS. 12, 13 and 14, one or more shank inserts 60 present in a given set 77 may have a first segment 88 whose length and/or position in the longitudinal direction 62 is different from the longitudinal length and/or longitudinal position of the first segment 88 of one or more other shank inserts 60 in that set 77. For example, the shank insert 60*b* illustrated in FIG. 13 has a first segment 88 whose longitudinal length, 89 is greater than the longitudinal length 89 of the first segment 88 of the shank insert 60*a* illustrated in FIG. 12 but is less than the longitudinal length 89 of the first segment 88 of the shank insert 60*c* of FIG. 14. While three shank inserts have been described as making up a set 77 only for the sake of illustration, it is to be understood that a set 77 of shank insert 60 may contain any arbitrary number of shank inserts 60 greater than or equal to two.

In some embodiments, one or more of the shank inserts 60 in a set 77 may have a second segment 91 whose length 92 and/or position in the longitudinal direction 62 differs from longitudinal length 92 and/or longitudinal position of the second segment 91 of one or more other shank inserts 60 in that set 77. For example, the shank insert 60*b* illustrated in FIG. 13 has a second segment 91 whose longitudinal length 92 is less than the longitudinal length 92 of the second segment 91 of the shank insert 60*a* illustrated in FIG. 12 but is greater than the longitudinal length 92 of the second segment 88 of the shank insert 60*c* illustrated in FIG. 14.

As shown by way of non-limiting examples in FIGS. 10 and 14, one or more of the shank inserts 60 in a set 77 may, in some embodiments, also include an intermediate segment 93 interposed longitudinally between a first segment 88 and a second segment 91. In some embodiments, the intermediate segment 93 may have a flexural rigidity profile which varies with longitudinal position in a manner which effects a substantially smooth and continuous transition from the flexural rigidity profile of the first segment 88 to the flexural rigidity profile of the second segment 92. In some embodiments, the flexural rigidity profile transition is monotonic. In some embodiments, the flexural rigidity profile of the intermediate section 93 may be substantially linear. In some embodiments, the flexural rigidity profile of the intermediate section 93 of one or more of the shank inserts 60 in a set 77 may include a substantially inverse sigmoid-shaped transition portion such as that which is included in the intermediate portions of each of the flexural rigidity profiles 81, 83 and 85 shown in FIG. 11.

In some embodiments, the first segment 88 of a shank insert 60 may be formed of a first material while the second segment 91 may be formed of a second material of higher elastic modulus than the first material. For example, a shank insert 60 may be formed by an injection molding process in which a first segment 88 may be a thermoset material, such as a phenolic or a thermosetting resin, or a thermoplastic material such as polypropylene, polycarbonate, acrylonitrile butadiene styrene (ABS) or other material which may be co-injected or co-molded with a second material which has a lower flexural rigidity to form the second segment 90. In some embodiments, the second segment 90 may be formed of a second material such as thermoplastic polyurethane (TPU) or a thermoplastic polyurethane (TPU) blend. As an option the first segment 88 may be made of a composite material, such as a thermoset or thermoplastic material which is blended with one or more reinforcing materials such as fiberglass, Kevlar®, carbon fiber, plant fiber or other reinforcing filler in an amount sufficient to make the first segment 88 of a shank insert 60 a desired degree more rigid than its second segment 91. It is not a requirement however that any shank insert 60 be made of more than one material nor is it a requirement that a shank insert 60 be segmented in any manner or not be uniform in any respect over all or any part of its length.

An intermediate segment 93 in some embodiments may optionally be formed in part from a material of which the first segment 88 is formed and in part from a material of which the second segment 91 is formed. For example, the intermediate segments 93 in the shank inserts 60*c* shown in FIGS. 10 and 14, respectively may optionally be formed of two or more layers 97, 98. Layer 97 may project from the first segment 88 and may be formed of the same material as the first segment 88. As an option in some embodiments, the first segment 88 and layer 97 of the intermediate segment 94 may be formed as a monolithic foot-supporting structure. Layer 99 may project longitudinally from the second segment 91 and may be formed of the same material as the second segment 91. Optionally but preferably, the second segment 91 and layer 99 of the intermediate segment 93 may be formed by an injection molding process. In some embodiments, the first segment 88, the layers 97 and 99 of the intermediate segment 93 and the second segment 91 may all be formed together as a unitary injection-molded member. For example, such a member may be formed by co-injecting or co-molding a first material to form the first segment 88 and layer 97 of the intermediate segment 93 and a second material to form the second segment 91 and layer 99 of the intermediate segment 93. In some embodiments, one or more of the shank inserts 60 may optionally be a shank insert 60*d* of a type that will now be described with reference to FIGS. 15 through 22.

Figure 15:
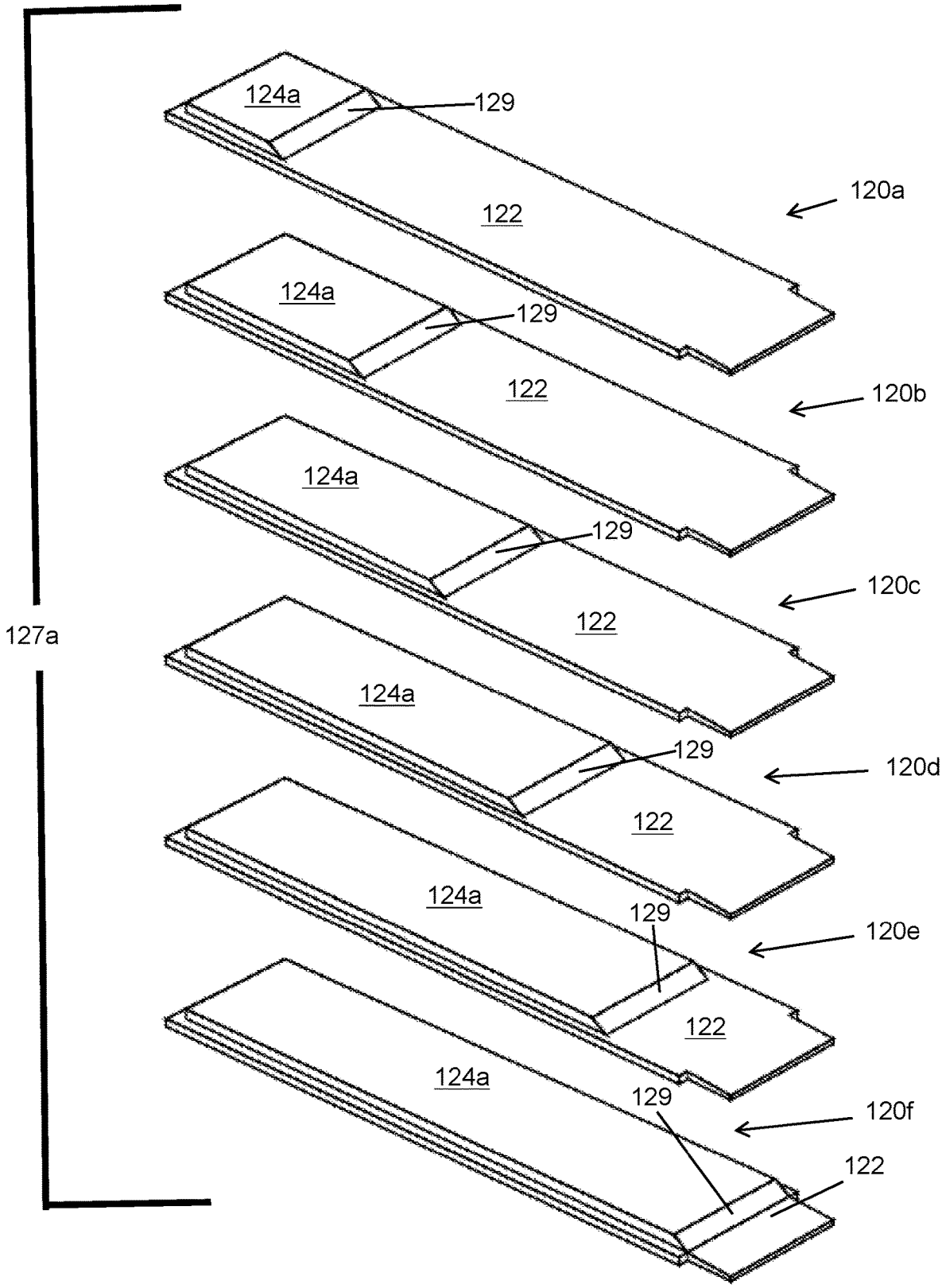
FIG. 15 is a perspective view of a first set of shank insert reinforcing members.
Figure 16:
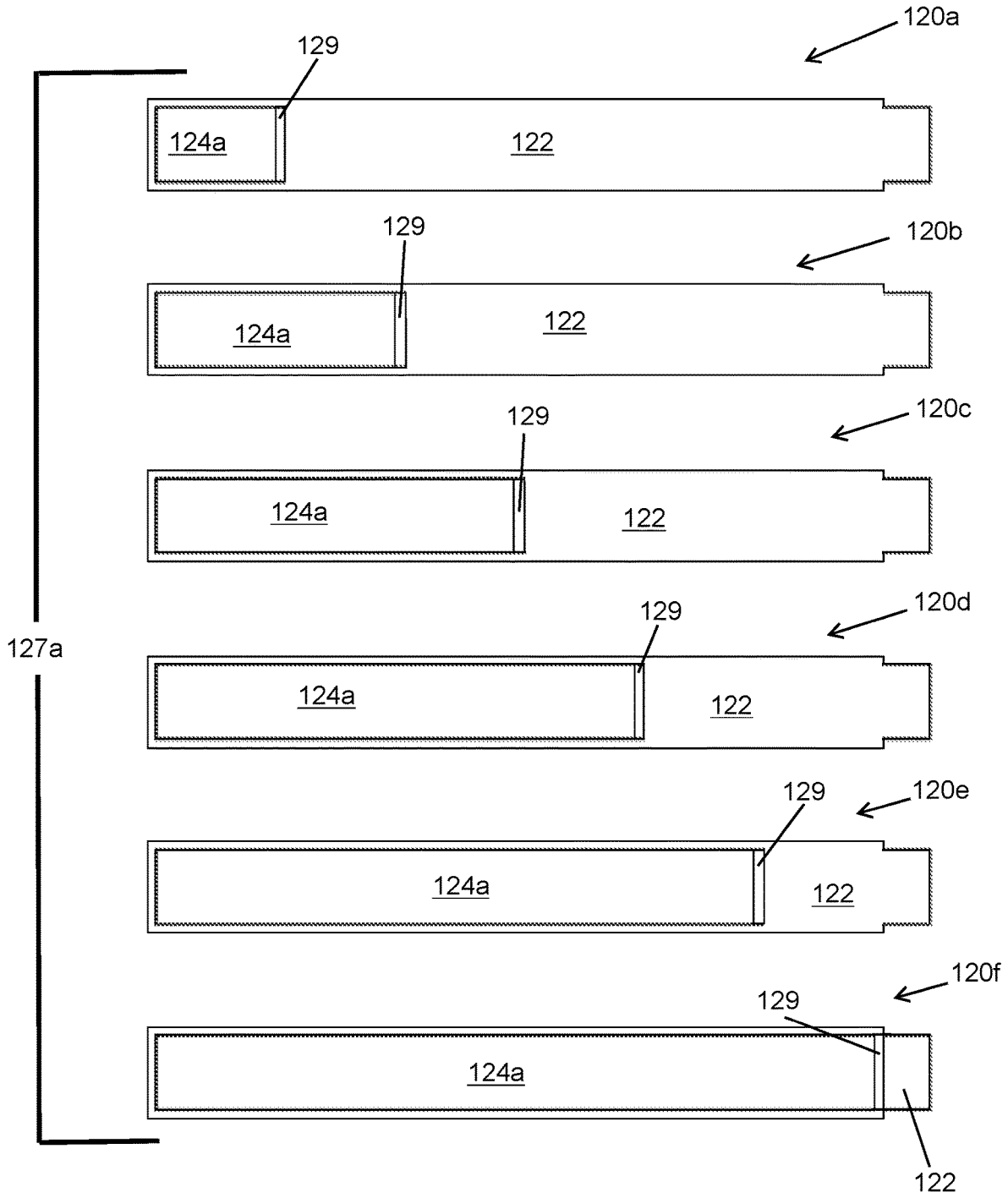
FIG. 16 is a top plan view of the first set of shank insert reinforcing members shown in FIG. 15.
Figure 17:
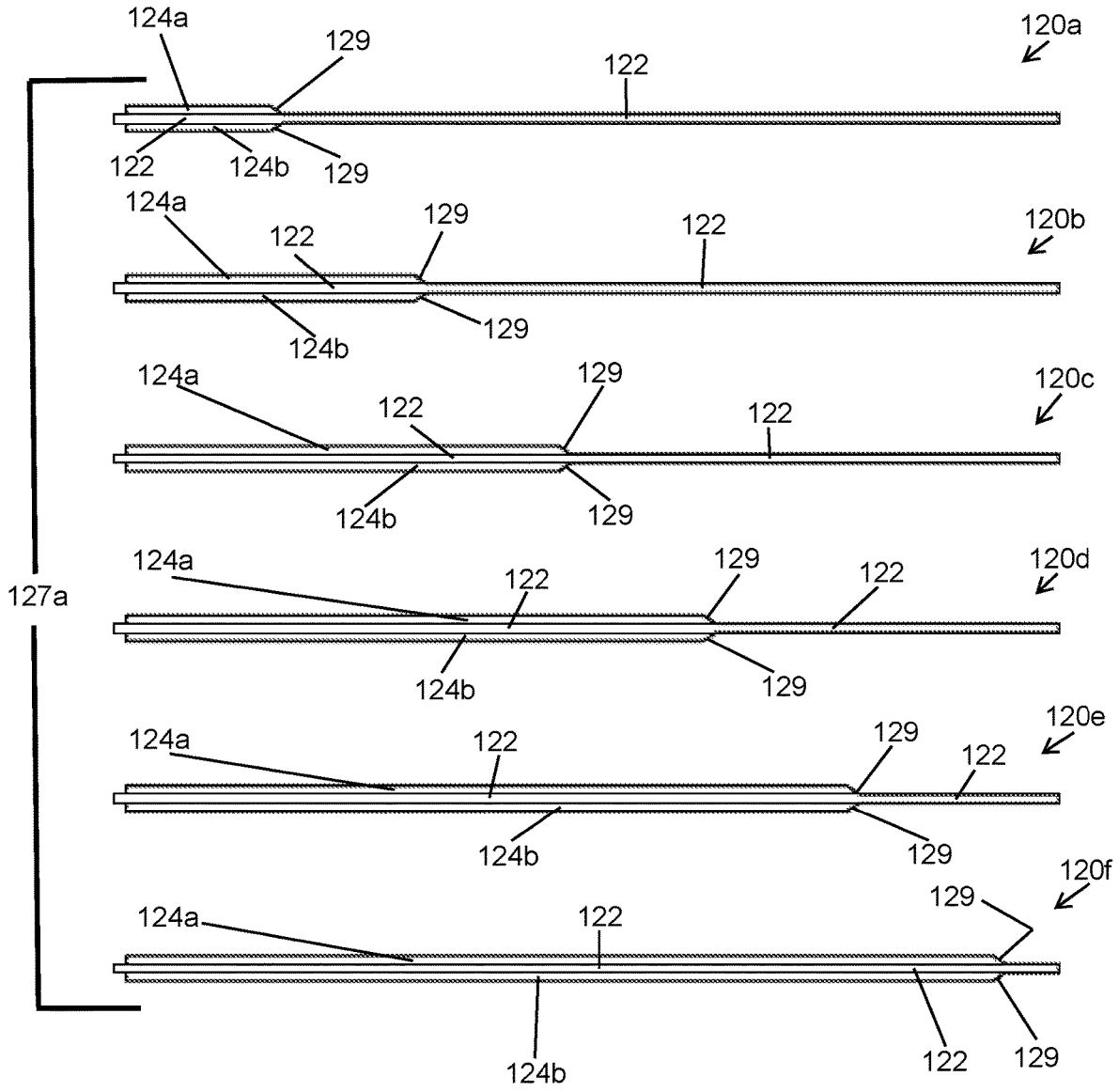
FIG. 17 is a side elevational view of the first set of shank insert reinforcing members shown in FIGS. 15 and 16.
Figure 21A:
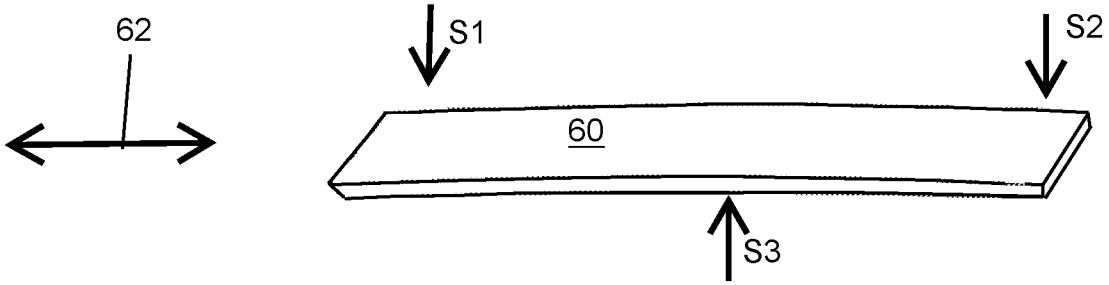
FIG. 21A is a schematic illustration of applying a sagging bending moment to a shank insert.
Figure 21B:
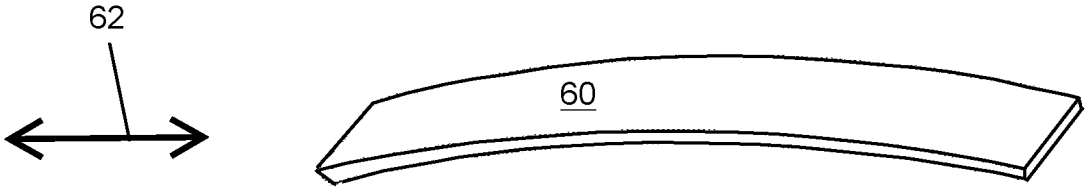
FIG. 21B is a perspective view showing the shank insert of FIG. 21A after having been reshaped into an altered shape.
Figures 21C, 21D:
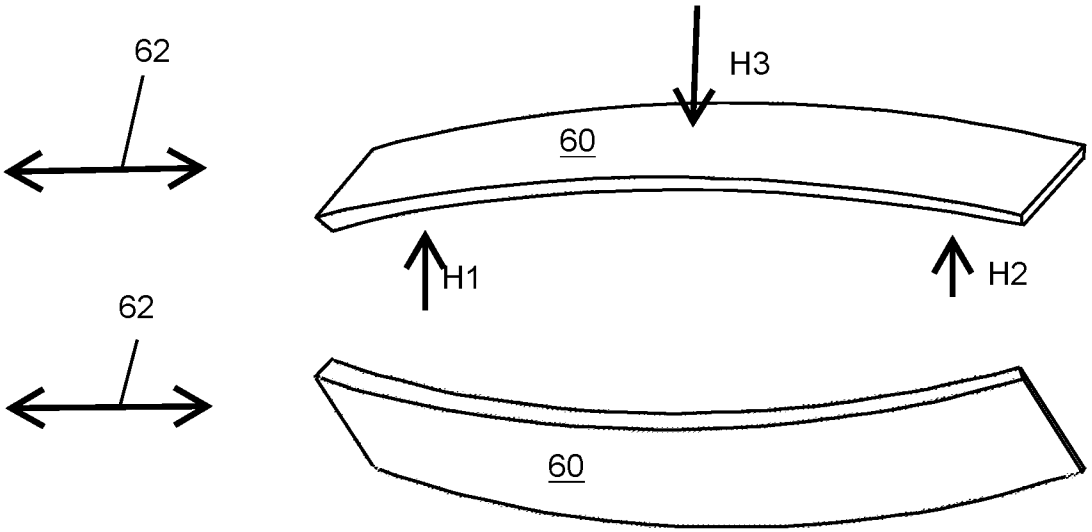
FIG. 21C is a schematic illustration of applying a hogging bending moment to a the shank insert of FIG. 21B.
FIG. 21D is a perspective view showing the shank insert of FIG. 21C which has been reshaped into a subsequent altered shape.
Figure 22:
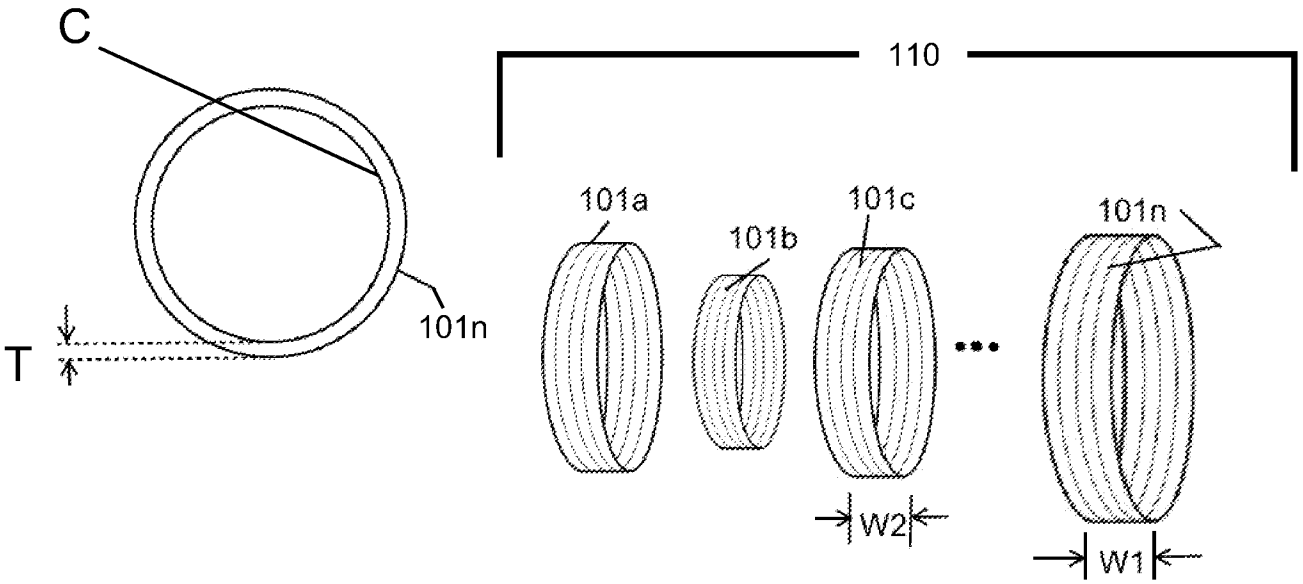
FIG. 22 is a schematic illustration of an example of a set of optional elastic loops.

As shown in FIGS. 21 and 22 a shank insert 60*d* may optionally include a reinforcing member 120. In some embodiments a reinforcing member 120 may include a substrate 122 which may carry one or more reinforcing ribs 124. A first reinforcing rib 124*a* may be carried by one face of the substrate 122 and a second reinforcing rib 124*b* may optionally be carried by a mutually opposed second face of the substrate 122. Each reinforcing rib 124 may have a length, in a direction corresponding to the longitudinal direction 62. For example, FIGS. 15, 16 and 17 illustrate a first set 127*a* of reinforcing members 120 which contains a plurality of reinforcing members 120*a*, 120*b*, 120*c*, 120*d*,

120*e* and 120*f*, each of which includes a pair or reinforcing ribs 124*a*, 124*b* which has a respective length which may differ from that of one or more of the other reinforcing members 120 in the same set 127*a*. For example, in the set 127*a* reinforcing member 120*a* has the shortest length and the remaining reinforcing members 120*b*, 120*c*, 120*d*, 120*e* and 120*f* each have a progressively greater length.

In some embodiments, the substrate 122 of a given reinforcing member 120 may have a flexural rigidity which is substantially lower than the total combined flexural rigidity of the one or more reinforcing ribs 124 present in the same given reinforcing member 120. The total combined flexural rigidity of the one or more reinforcing ribs 124 present in a reinforcing member 120 may be substantially greater than the flexural rigidity of the substrate 122 present in the same reinforcing member 120. In some embodiments, a reinforcing member 120 may be formed of two or more different materials using a process such as injection molding, casting, extrusion or machining in such a way that a longitudinal portion representing one or more reinforcing ribs 124 is of a shape and/or cross sectional area which provides that portion with a substantially greater flexural rigidity than the remainder of the reinforcing member 120. Reinforcing ribs 124 may be formed of any suitable material or combination of materials. In some embodiments one or more reinforcing ribs 124 may be formed of a filled or unfilled Nylon® or other polyamide material, filled or unfilled polytetrafluoroethylene (PTFE), a filled or unfilled thermoset material such as a phenolic or other thermosetting resin. In some embodiments one or more reinforcing ribs 124 may be formed of a thermoplastic material such as polypropylene, polycarbonate, acrylonitrile butadiene styrene (ABS) or other material. As an option, the first segment 88 may be made of a composite material, such as a thermoset or thermoplastic material which may be blended with one or more reinforcing materials such as glass, fiberglass, Kevlar®, carbon fiber, plant fiber or other reinforcing filler in an amount sufficient to provide a desired degree of rigidity. In some embodiments, the substrate 122 may be formed of a thermoplastic material. In some embodiments the thermoplastic material may comprise or consist of a thermoplastic elastomer. In some such embodiments the thermoplastic elastomer may be a thermoplastic polyurethane (TPU) or a thermoplastic polyurethane (TPU) blend.

In some embodiments, a shank insert 60*d* may include a reinforcing member 120 having no substrate 122. By way of non-limiting example, a reinforcing member 120 may be formed using a process such as injection molding, casting, extrusion or machining in such a way that a longitudinal portion of a reinforcing member 120 which forms one or more reinforcing ribs 124 has a shape and/or cross sectional area which provides that portion with a substantially greater flexural rigidity than the remainder of the same reinforcing member 120.

Figure 18:
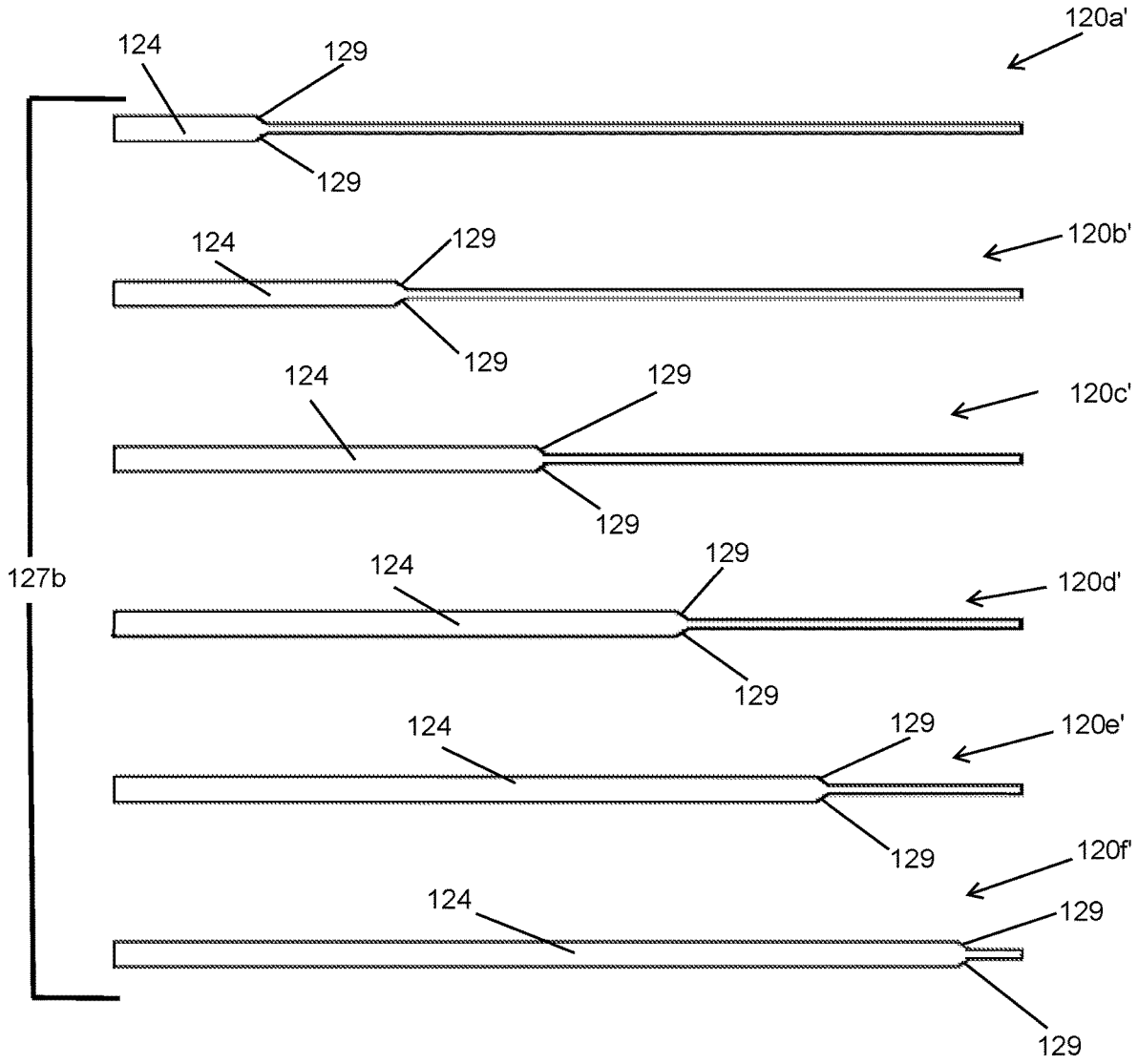
FIG. 18 is a perspective view of a second set of shank insert reinforcing members alternative shank insert.
Figure 19:
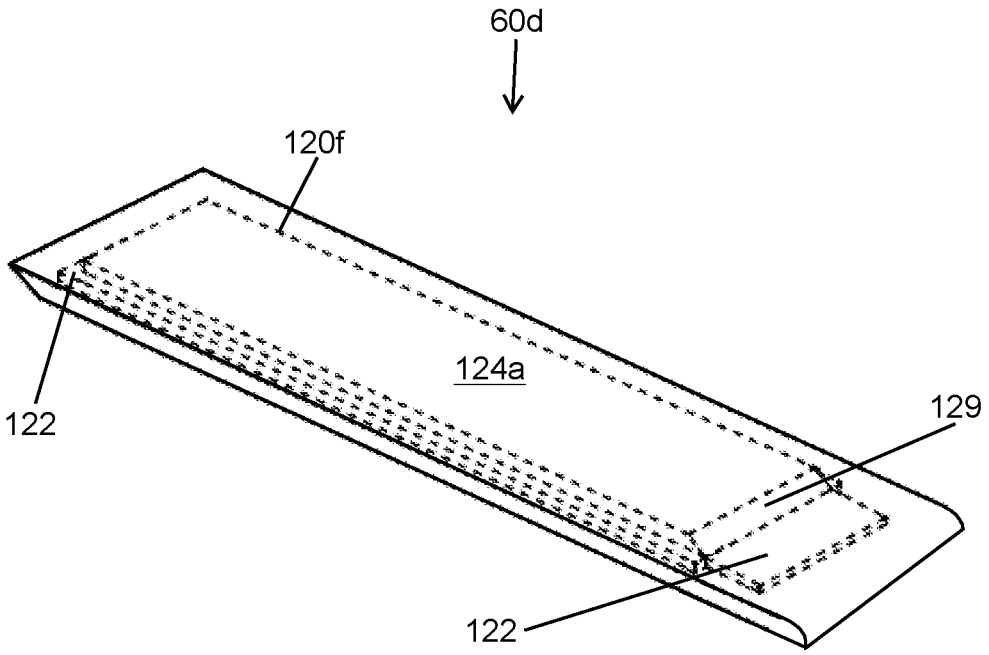
FIG. 19 is a perspective view of an alternative shank insert.
Figure 20:
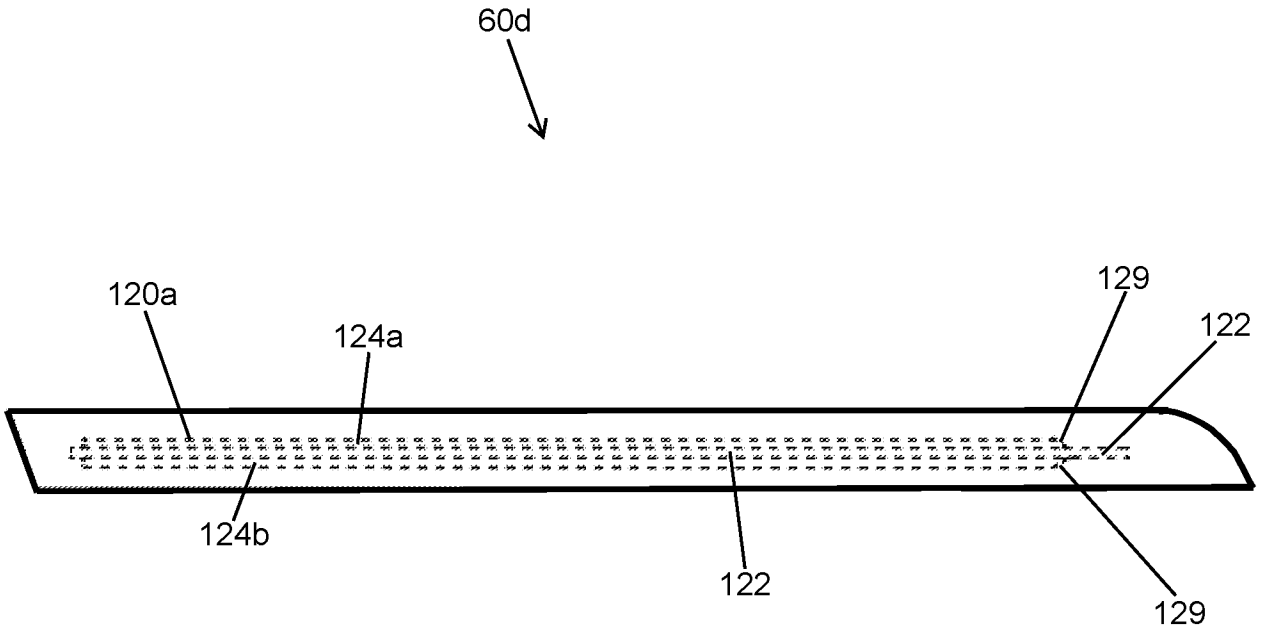
FIG. 20 is a side elevational view of the alterative shank insert shown in FIG. 19.

FIG. 18, illustrates a second set 127*b* of reinforcing members 120 which contains a plurality of reinforcing members 120*a*', 120*b*', 120*c*', 120*d*', 120*e*' and 120*f*', each of which may include a reinforcing rib 124 which has a respective length which may differ from that of one or more of the other reinforcing members 120 in the same set 127*b*. For example, in the set 127*b* reinforcing member 120*a*' has the shortest length and the remaining reinforcing members 120*b*', 120*c*', 120*d*', 120*e*' and 120*f*' each have a progressively greater length. In the second set 127*b*, the reinforcing rib 124 of reinforcing members 120*a*', 120*b*', 120*c*', 120*d*', 120*e*' and 120*f*' is formed by a portion of those reinforcing members which is of the same material as, but is thicker, and thus more resistant to bending, than the remaining portions of those reinforcing members. To avoid or reduce stress concentrations, one or both ends of one or more of the reinforcing ribs 124 reinforcing members 120 may optionally terminate in a tapered or radiused transition zone 129. In some embodiments, a ballet pointe shoe 20 may include a shank insert 60*d* having a reinforcing member 120 which is embedded, either completely or partially, in the body of the shank insert 60*d*.

While in some embodiments a shank insert 60 may be substantially uniform cross-sectional size and shape over its length, L, such is not essential. It is to be understood that the flexural rigidity profile of a shank insert 60 is not determined solely by the material or materials of which it is made but is also dependent on shape and dimensional factors. Thus, a desired flexural rigidity profile may be achieved, at least in part, reshaping a shank insert 60 at one or more longitudinal positions or regions along its length L.

In certain embodiments, the support characteristics and/or fit of a ballet pointe shoe 20 may be customized or adjusted by reshaping one or more shank inserts 60 from a previous shape into an altered shape, and/or by re-shaping the toe box 53 of the monolithic foot-supporting structure 50 from a previous shape into an altered shape. By reshaping the wall 56, the effective size and shape if the inner cavity 55 can be effectively changed. Reshaping of the toe box 53 of the monolithic foot-supporting structure 50, can be carried out while the monolithic foot-supporting structure 50 remains in the ballet pointe shoe 20 and that not even partial deconstruction of the ballet pointe shoe 20 is required to reshape the toe box 53.

In some embodiments a ballet pointe shoe 20 may include a shank insert 60 that has an altered shape that differs from a previous shape of the same shank insert 60. In some embodiments, a ballet pointe shoe 20 may include a removable and replaceable shank insert 60 that has been heated and reshaped at any time after initial manufacture of the shank insert 60. In some embodiments, reshaping one or more shank inserts 60 from a previous shape into an altered shape may be achieved by carrying out a method which includes the steps of: (a) forming at least a portion of the shank insert of a thermoplastic material, (b) softening the shank insert by applying heat, (c) applying a first bending moment to the shank insert 60 to reshape the shank insert 60 into an altered shape which differs from its previous shape, and (d) lowering the temperature of all, or at least the portion, of the shank insert 60 to a temperature which is sufficiently below the softening temperature to permit the altered shape to be retained semi-permanently that is, retained even after the applied bending moment has been removed, unless and until the thermoplastic material is subsequently heated to, or above, a softening temperature and reshaped by application of a second bending moment into a subsequent altered shape. FIG. 21A shows a shank insert 60 of a previous shape. FIG. 21B shows the same shank insert 60 in an altered shape that differs from the previous shape after reshaping has been carried out. The altered shape of the shank insert 60 differs from its previous shape.

The first bending moment may be either a sagging bending moment, as illustrated in FIG. 21A or a hogging bending moment as illustrated in FIG. 21C. The softening temperature may be a temperature, or a temperature range, which is below the melting temperature of the thermoplastic. In some embodiments, step (b) above may be carried out by heating all, or at least the portion, of the shank insert 60 to a softening temperature of the thermoplastic material, the softening temperature being a temperature, or a temperature range, which is below the melting temperature of the thermoplastic material. In some embodiments step (c) above may be carried out by applying the first bending moment manually. In some embodiments step (c) above may be carried out by applying the first bending moment by forcing the shank insert 60 into contact with the surface of a die, the die surface being of a shape which determines the altered shape of the shank insert 60. In some embodiments the altered shape of the shank insert 60 may be an arcuate shape. In some embodiments the altered shape of the shank insert 60 may be a curved shape. In some embodiments a subsequent altered shape of the shank insert 60 may be a second arcuate shape. In some embodiments a subsequent altered shape of the shank insert 60 may be a second curved shape.

Heat for softening a shank insert 60 may be generated or applied to the shank insert 60 in any suitable manner such as, for example, by forced hot air heating using a hair dryer or heat gun, heating in an a conventional oven, convection oven, microwave heating, infrared heating or immersion in hot water or other hot liquid. A bending moment for reshaping a shank insert 60 may be applied in any suitable manner, either by hand or otherwise. In some embodiments a bending moment may be applied to a shank insert 60 manually or with the aid of a machine.

In some embodiments, the methods just described may optionally comprise the step of reshaping the shank insert 60 into a subsequent altered shape after the steps (a) through (d) just described have been carried out. Such optional step may, in some embodiments, comprise the substeps of: (i) heat-softening the shank insert 60 by reheating all, or at least the portion, of the shank insert 60 to a softening temperature of the thermoplastic material, (ii) applying a second bending moment to the shank insert 60 to reshape the shank insert 60 into a subsequent altered shape, the second bending moment being either a hogging bending moment or a sagging bending moment, and (iii) lowering the temperature of all, or at least the portion, of the shank insert 60 to a temperature which is sufficiently below the softening temperature to permit the shank insert to retain the subsequent altered shape semi-permanently. Lowering the temperature can be carried out actively and/or passively. In some embodiments the optional step of reshaping the shank insert 60 into a subsequent altered shape can be repeated on as many one or more arbitrary occasions as the needs or preferences of a dancer dictate by repeating the substeps (i) through (iii) just described in this paragraph. In some embodiments the optional step of reshaping the shank insert 60 into a subsequent altered shape may be carried out by applying the second bending moment by forcing the shank insert 60 into contact with the surface of a second die, the second die surface being of a shape which determines the subsequent altered shape of the shank insert 60. Examples of suitable thermoplastic materials of which all or at least a portion of the shank insert 60 may be made in order to facilitate selective heating and reshaping of the shank insert 60 include but are not limited to polypropylene or a thermoplastic elastomer such as a thermoplastic polyurethane (TPU) or a thermoplastic polyurethane (TPU) blend.

FIG. 21A illustrates a first bending moment being applied to a shank insert 60 which has been heated to a softening temperature. In FIG. 21A, the first bending moment is, by way of non-limiting example, a sagging bending moment represented by arrows S1, S2 and S3 but it is to be understood that in some embodiments a hogging bending moment could be applied as an alternative first bending moment. FIG. 21B shows the shank insert 60 of FIG. 21A in an altered shape which is retained semi-permanently after lowering the temperature of the shank insert 60 sufficiently below the softening temperature, even if the first bending moment is no longer applied.

FIG. 21C illustrates a second bending moment being applied to the shank insert 60 of FIG. 21B after same has been re-heated to a softening temperature. In FIG. 21C, the second bending moment is, by way of non-limiting example, a hogging bending moment represented by arrows H1, 112 and H3 but it is to be understood that in some embodiments a sagging bending moment could be applied as an alternative first bending moment if it were desired to reshape the shank insert of FIG. 21C into a curve or an arc more acute than the curved shape illustrated in FIG. 21C. FIG. 21D shows the shank insert 60 of FIG. 21C in subsequent altered shape which is retained semi-permanently after lowering the temperature of the shank insert 60 sufficiently below the softening temperature, even if the bending moment is no longer applied. Although the subsequent altered shape shown in FIG. 21D happens to be a hogging curve shape by way of non-limiting example, it is to be understood that if the second bending moment applied to the shank insert 60 of FIG. 21C were to be a sagging bending moment instead of a hogging bending moment, the shank insert 60 would assume a subsequent altered shape different from that shown in FIG. 21D.

In use, a shank insert 60 whose flexural rigidity profile may best suit the needs of a different application and/or the individual physical characteristics (e.g. third aspect, strength, etc.) of a particular ballet dancer and/or individual preferences of that ballet dancer is selected from a set 77 which may include at least two shank insets 60 whose respective flexural rigidity profiles differ from one another as to one or more parameters. Such parameters may include magnitude and/or in shape and or longitudinal position at which magnitude changes and/or rate of change of magnitude. The shank insert 60 selected from a set 77 is then inserted into the tunnel 61 in the shank body 58. To replace one shank insert 60 with another from the set 77, a selected shank insert 60 is inserted into the tunnel 61 by way of the mouth 65 after any shank insert 60 previously present in the tunnel 61 has been removed from the tunnel 61 by way of the mouth 65.

In one example of alternative mode of use a ballet pointe shoe 20 may be worn and used for ballet dancing or ballet dance training with either no shank insert 60 present at all or with an installed shank insert 60 which is highly flexible over its entire working length. In such alternative mode of use a ballet pointe shoe 20 can be used in lieu of what is commonly referred to in the art as a "demi-pointe shoe". Thus, as used herein and in the claims the term "ballet pointe shoe" is not to be construed to exclude a demi-pointe shoe.

In certain embodiments, the toe box 53 or at least a portion of the peripheral wall 56 of toe box 53 may be made of one or more thermoplastic materials of a type capable of being selectively heated and reshaped at any time after initial manufacture of the ballet pointe shoe 20 in which the monolithic foot-supporting structure 50 is incorporated. This may be achieved by carrying out the steps of: (a) heating all, or at least the portion of, the wall 56 to a softening temperature of the thermoplastic material, the softening temperature being a temperature or temperature range which is below the melting temperature of the thermoplastic material, (b) applying external force, F, to the softened material to reshape at least a portion of the interior cavity 55 of the toe box 53 into an altered shape which differs from its previous shape, and (c) lowering the temperature of the thermoplastic material to a temperature which is sufficiently below the softening temperature to permit the altered shape to be retained semi-permanently that is, retained even after the applied reshaping force, F, has been removed. Lowering the temperature can be carried out actively and/or passively. One example of a suitable thermoplastic material of which all or at least a portion of the wall 56 of toe box 53 may be made in order to facilitate selective heated and reshaping of the toe box 53 is a thermoplastic elastomer such as thermoplastic polyurethane (TPU).

In some embodiments, the method of reshaping toe box 53 may optionally comprise step of reshaping the toe box 53 into a subsequent altered shape after the steps (a) through (c) described in the paragraph immediately above have been carried out. Such optional step may, in some embodiments, comprise the substeps of: (i) re-heating all, or at least the portion of, the wall 56 to a softening temperature of the thermoplastic material, (ii) applying external force, F, to the softened thermoplastic material to reshape at least a portion of the interior cavity 55 of the toe box 53 into a subsequent altered shape, and (iii) lowering the temperature of the thermoplastic material to a temperature which is sufficiently below the softening temperature to permit the subsequent altered shape to be retained semi-permanently. The optional step of reshaping the toe box 53 into a subsequent altered shape can, if desired, be repeated one or more times as the needs and/or preferences of a ballet dancer dictate by repeating the substeps (i) through (iii) just described.

It is to be understood that the entirety of the wall 56 of the toe box 53 can be formed entirely of thermoplastic material in some embodiments. In other embodiments, only one or more portions of wall 56 where reshaping of the toe box 53 may be formed of thermoplastic material. In some embodiments, one or more regions of wall 56 may be formed of a different respective thermoplastic material than other regions of wall 56. In some embodiments one or more regions of wall 56 where reshaping may not be desired may be formed in whole or in part of material other than a thermoplastic material.

In some embodiments, an external force for carrying out reshaping of the toe box 53 may be applied to the wall 56 of toe box 53 while it is in a heat-softened state at a time when the foot 41 of a particular ballet dancer is present in the foot compartment 5 of the ballet pointe shoe 20 in which the monolithic foot-supporting structure 50 is incorporated so that the interior cavity 55 of the toe box 53 may be reformed into an altered shape which more closely conforms to the size and/or shape of the foot 41 of that particular ballet dancer and/or better suits the preferences of that particular ballet dancer. A reshaping force, F, may be applied to the toe box 53 in any suitable manner, either by hand or otherwise. In some embodiments the external force may be applied by hand such as by pressing or squeezing at least a portion of the of the wall 56 of toe box 53. In some embodiments, an external force for carrying out reshaping of interior cavity 55 may be applied to the wall 56 of toe box 53 while it is in a softened state at a time when a forming die of desired size and shape is present in the ballet pointe shoe 20 in which the monolithic foot-supporting structure 50 is incorporated so that the interior cavity 55 of the toe box: may be reformed into an altered shape which more closely conforms to the size and/or shape of the forming die. If desired, forming die may be inserted into the toe box 53 manually and/or by a machine or with the aid of a machine. In some embodiments, a forming die may consist of a shoe last or a forward portion of a shoe last.

Heat for softening the thermoplastic material of the toe box 53 may be generated and applied in any suitable manner such as by forced hot air heating using a hair dryer or heat gun, heating in an a conventional oven, convection oven, microwave heating, infrared heating or immersion in hot water or other hot liquid.

Reshaping of the interior cavity 55 of a toe box 53 herein can be carried out at any time or place after initial manufacture such as at a point of sale or even at a point of use of a monolithic foot-supporting structure 50 and/or a ballet pointe shoe 20. Reshaping of the interior cavity 55 of toe box 53 affords not only a better fitting and more comfortable ballet pointe shoe 20 but also makes it possible to provide properly fitting ballet pointe shoe 20 for different dancers without need to manufacture, ship and/or inventory as many different sizes and/or shapes of ballet pointe shoe 20 as would otherwise be required. Also, the reshaping of interior cavity 55 can be carried out at any time or place after initial manufacture such as at a point of sale or even at a point of use in order to adjust customize the ballet pointe shoe 20 to suit the needs or preferences of a particular dancer.

Moreover, reshaping of the interior cavity 55 wall 56 of toe box 53 as described herein can be carried out repeatedly as many times as may be desired over the useful of the monolithic foot-supporting structure 50 and/or a ballet pointe shoe 20 in order to suit the needs or preferences of a particular dancer at any given point in time. Such needs and preferences, can change from time to time for a variety of reasons. For example, a ballet pointe shoe 20 of a young dancer may be reshaped one or more times to accommodate changes in the size and/or shape of the of foot due to growth of the dancer as the dancer grows. Reshaping of the interior cavity 55 of toe box 53 may also be carried out to accommodate temporary or permanent changes in the size and/or shape of the of foot 41 a dancer due to swelling or injury. For instance, a dancer whose foot may swell or develop a blister or other tender area may desire to reshape the interior cavity 55 of toe box 53 to relieve pressure on the affected area. Conversely, a particular injury or condition of the foot 41 of a dancer may benefit by reshaping of the interior cavity 55 of toe box 53 to provide increased pressure or support for the foot 41 at one or more areas within cavity 55. Once the foot injury or condition is resolved, the monolithic foot-supporting structure 50 and/or the ballet pointe shoe 20 in which the monolithic foot-supporting structure 50 is incorporated may optionally be reshaped yet again to restore the interior cavity 55 of the toe box 53 to a prior shape or to reshape it into a new subsequent altered shape which may differ from any prior shape.

Some embodiments of a ballet pointe shoe 20 may include an optional elastic loop 101. An elastic loop 101 be formed in part or entirely of an elastic band 99 which may at least partially surround or overlap a portion of the foot 41 of a dancer during use. In some embodiments, elastic loop 101 may be formed of a single piece of material. In other embodiments elastic loop 101 may be formed of two or more pieces of material which may be joined to one another to form all or part of elastic loop 101. An elastic loop 101 may be removably and replaceably mounted at an arch or midfoot portion of the ballet pointe shoe 20 in such a way that in use, the loop 101 may continuously exert an elastic force which continuously urges the shank body 58 and an insole 32 if one is present, toward the sole of the foot 41 of the dancer. In some embodiments the midsole may comprise or include a shank body 58 and/or a shank insert 60. In some embodiments, the elastic loop 101 may be mounted within the upper 22 such that during use, an upper portion 103 of the loop 101 may also overlap an instep portion of the foot 41 such that in use, the upper portion 103 of the elastic loop 101 continuously applies an elastic compressive force between an instep portion of a foot of a dancer and the shank body 58. This continuously urges the shank body 58, and the insole 32 if one is present, to bear forcibly toward the sole of the foot, even at times the dancer might be airborne. In some embodiments, the lower portions 105*a*, 105*b* of the elastic loop 101 may be located at a position in the longitudinal direction 62 which preferably lies within a range of longitudinal positions extending along at least a portion of the longitudinal span of the arch of the foot 41 of the dancer. The elastic loop 101 may include side portions 106 each of which may extend between upper portion 103 and a respective one of the lower portions 105*a* and 105*b*.

In some embodiments and/or modes of use, an elastic loop 101 may be mounted by releasably capturing a portion of elastic loop 101 between two structures lying beneath the insole 32. An example is illustrated in FIG. 4B. There, a lower portion 105*a* of the elastic loop 101 is routed beneath the shank body 58, in this example beneath the ledge 115 of the shank body 58, while the upper portion 103 of the elastic loop 101 is routed over the instep of the foot 41. In FIG. 4B a shank insert 60 is installed and has a rear portion 68 that extends longitudinally rearward of the mouth 65 of the tunnel 61 in which the forward portion 69 of the shank insert 60 is received. The lower portion 105*a* of the elastic loop 101 is releasably captured between the ledge 115 the rear portion 68 of the of the shank insert 60. In use, the weight exerted by a foot of dancer and the elastic force exerted by the elastic loop 101 clamps the elastic loop 101 in place without requiring the elastic loop 101 to be glued, sewn, welded, stapled, riveted or otherwise permanently fastened to the ballet pointe shoe 20 at a particular longitudinal position. The elastic loop 101 can at any time be easily repositioned longitudinally relative to shank body 58 by removing the shoe from the foot 41 and manually adjusting its longitudinal position relative to shank body 58. The elastic loop 101 is not only longitudinally repositionable but is also removable and/or replaceable with another elastic loop 101.

Figure 25:
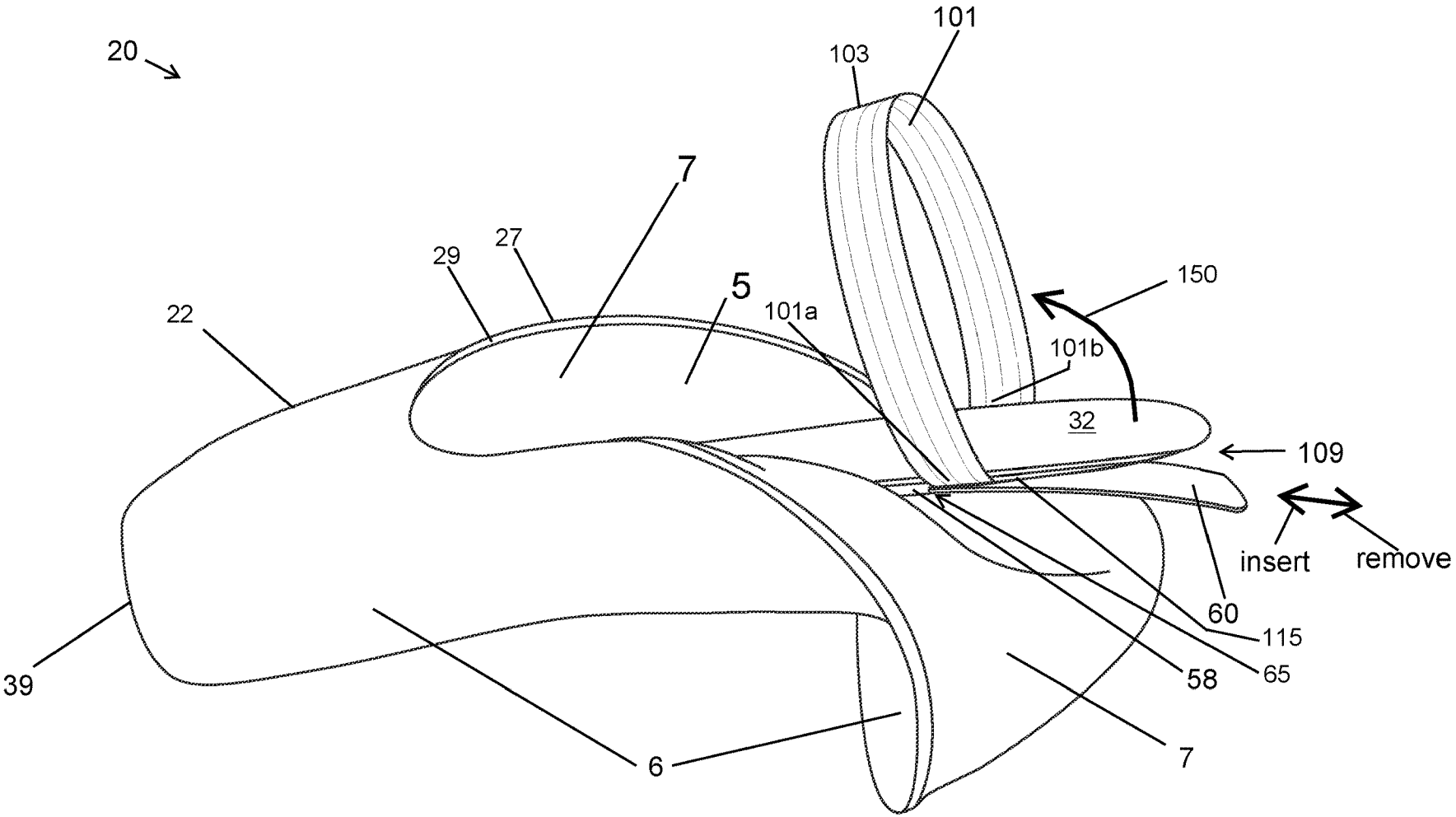
FIG. 25 is a schematic illustration of insertion and/or removal of a shank insert.

FIG. 25 schematically shows a non-limiting example of an loop 101 and/or an optional shank insert 60 being inserted and and/or removed from a ballet pointe shoe 20. In some embodiments, the ledge 115 and/or the insole 32 and/or the insole 32 and the ledge 115 of shank body 58 can be lifted or pivoted upward as indicated by arrow 150 sufficiently to reveal and gain functional access to the mouth 65 of tunnel 61 by way of the foot compartment 5 and the throat 27 to permit insertion and/or withdrawal of a shank insert 60 and/or permit installation, removal and/or longitudinal repositioning of an elastic loop 101. In lieu of, or in addition to lifting or pivoting the ledge 115 and/or the insole 32 and/or the insole 32 and the ledge 115, the upper 22 of the ballet pointe shoe 20 may be bent downward at the heel 26 to reveal and gain functional access to the mouth 65 of tunnel 61 by way of the foot compartment 5 and the throat 27. One example of such bending is illustrated in FIG. 25. However, in addition to such bending, FIG. 25 also shows, for clarity of illustration a rear portion of the throat 27 and foot compartment 5 of the upper 22 in an everted condition, i.e. "turned inside out". It is to be understood that complete or partial eversion is permissible in order to reveal the mouth 65 of tunnel 61 or gain functional access to the mouth 65 of tunnel 61 by way of the foot compartment 5 and throat 27 but complete or partial eversion is not required.

In some preferred embodiments, an elastic loop 101 may be mounted in any of a number of different ways. For example, if the mode of use of FIG. 4B is desired the elastic loop 101 may be inserted or removed by way of a temporary gap between 109 the shank insert and the ledge 115 of shank body 58 as illustrated in FIGS. 4B and 25.

Figure 23:
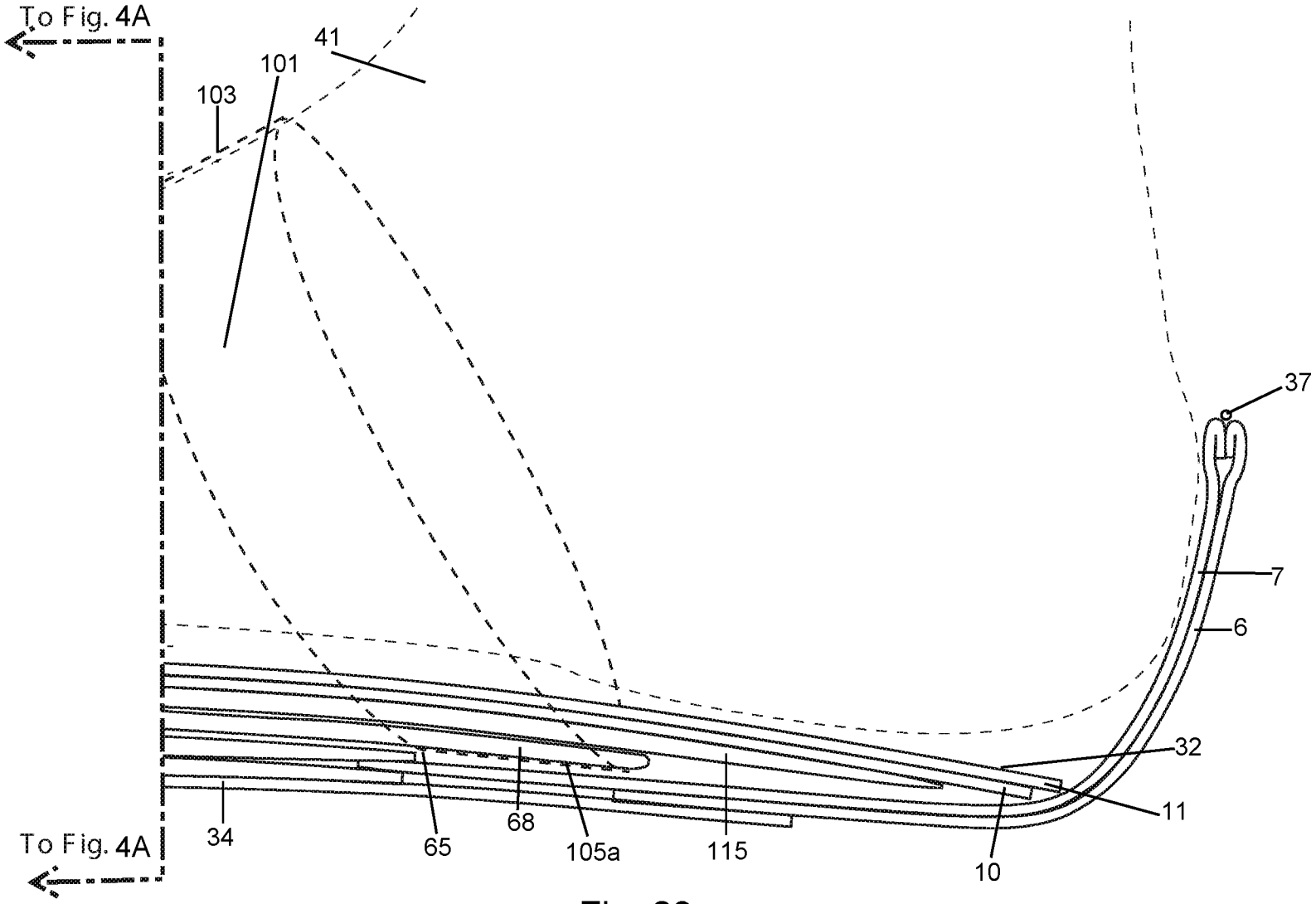
FIG. 23 is a partial sectional view similar to FIG. 4B except showing an optional elastic loop installed in a first alternative manner.

In some alternative embodiments and/or modes of use, an elastic loop 101 may be mounted as illustrated in FIG. 23. There, the lower portion 105*a* of an elastic loop 101 is routed beneath the shank body 58 as well as beneath a portion of an installed shank insert 60. In FIG. 23 a shank insert 60 is installed and has a rear portion 68 that extends longitudinally rearward of 22 mouth 65 of the tunnel 61. In the example shown, at least a portion of the ledge 115 of shank body 58 also extend rearward of the mouth 25 and the mouth 56 and the ledge 115 of the shank body 58 are both disposed interiorly of the inner liner 7. A lower portion 105*a* and/or 105*b* of the elastic loop 101 is routed beneath the rear portion 68 of the shank insert, as well as beneath the ledge 115 of the shank body 58 and the upper portion 103 of the elastic loop 101 is routed over the instep of the foot 41. The elastic loop 101 can at any time be easily repositioned longitudinally relative to shank body 58 by removing the shoe from the foot 41 and manually adjusting its longitudinal position relative to rear portion 68 of the shank insert 60. The elastic loop 101 mounted in this manner is not only longitudinally repositionable but is also removable and/or replaceable with another elastic loop 101.

Figure 24A:
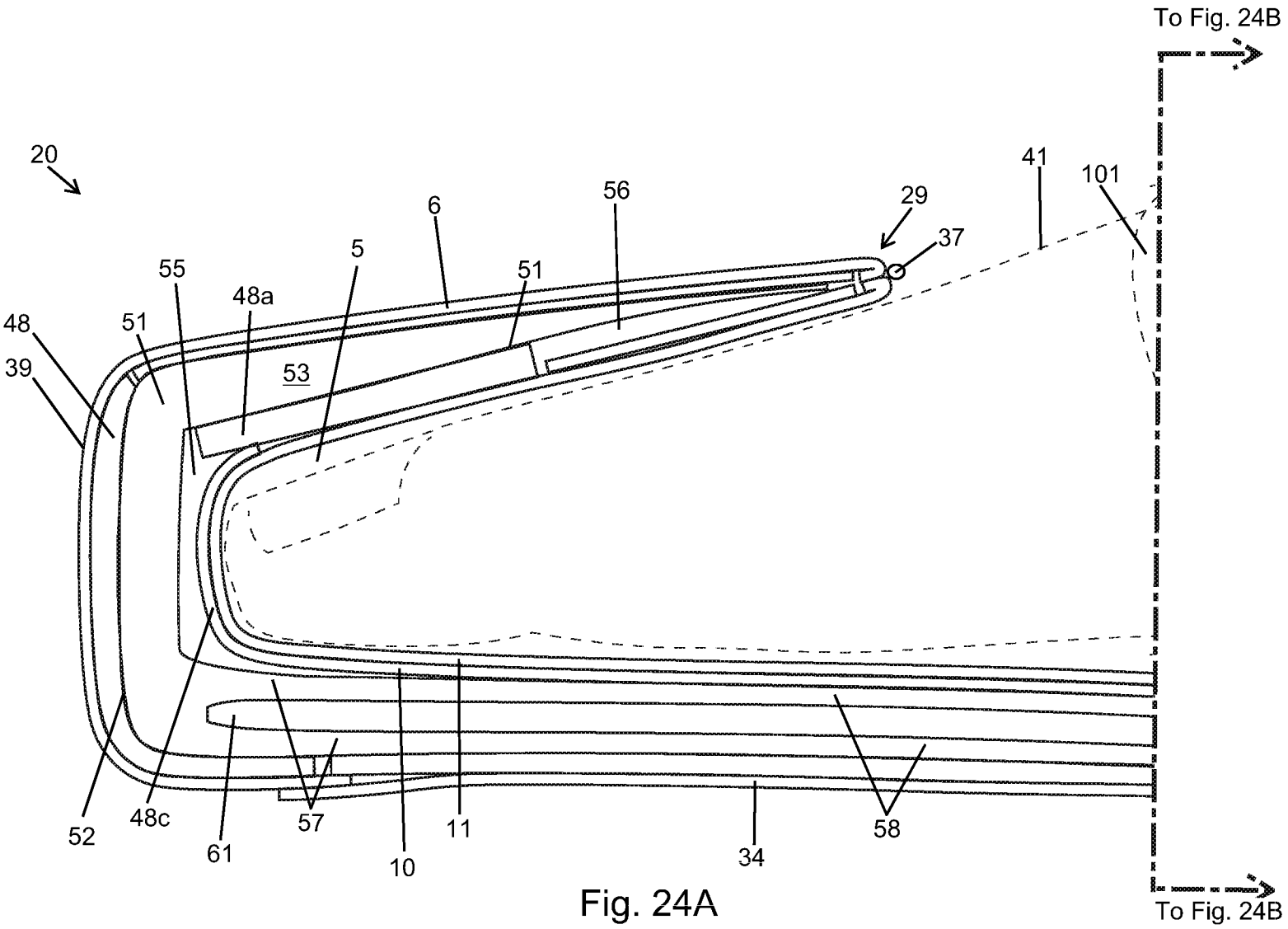
FIG. 24A is a first partial sectional view similar to FIG. 4A except that no shank insert is installed in the ballet pointe shoe.
Figure 24B:
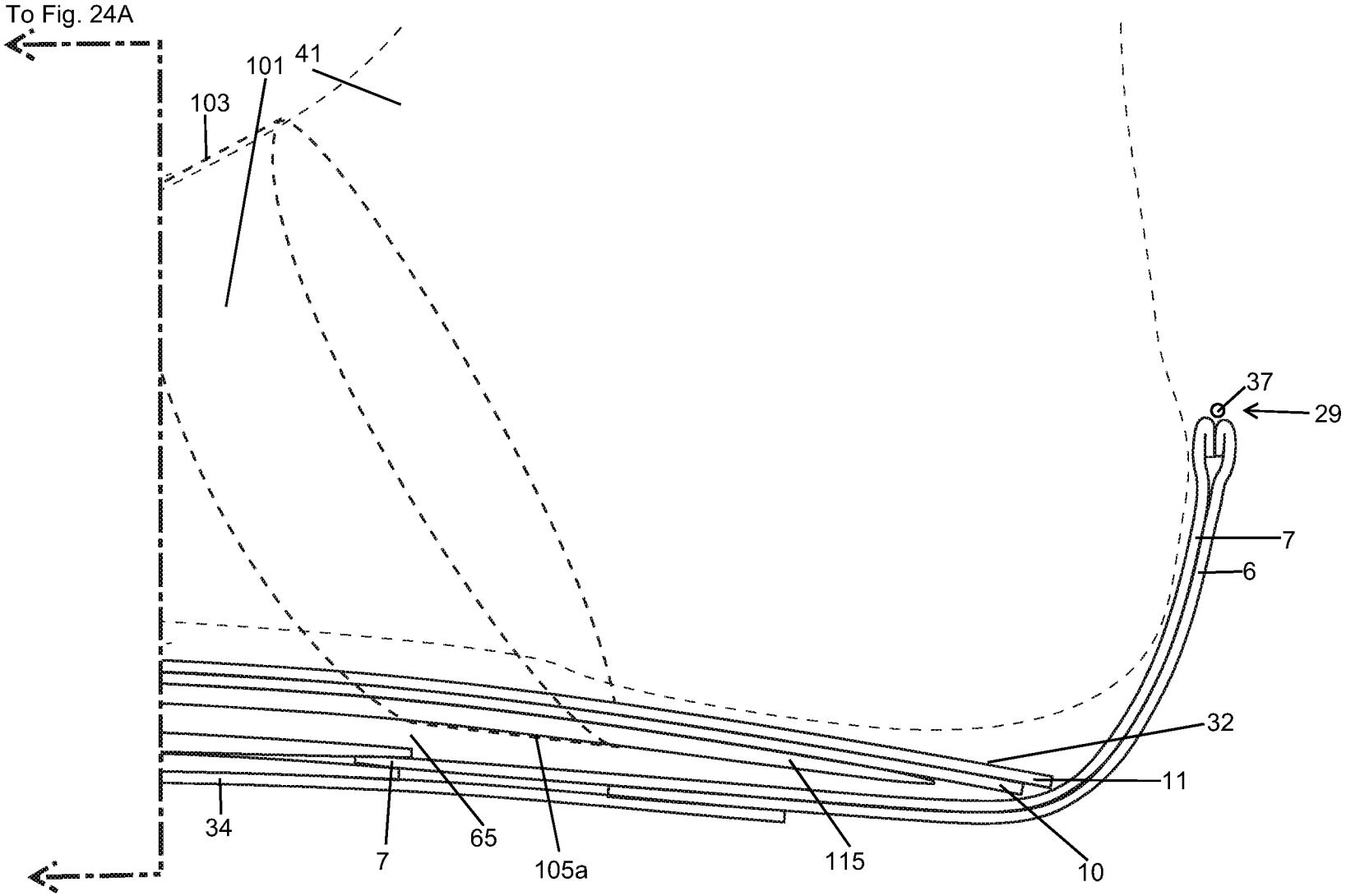
FIG. 24B is a second partial sectional view similar to FIG. 4B except that no shank insert is installed in the ballet pointe shoe.

FIGS. 24A and 24B together illustrate some embodiments and/or modes of use of a ballet pointe shoe 20 in which no shank insert 60 is installed in tunnel 61. As shown in FIG. 23B the lower portion 105*a* of an elastic loop 101 is routed beneath the shank body 58. In this example, the lower portion 105*a* of an elastic loop 101 is routed beneath the ledge 115 of the shank body 58 while the upper portion 103 of the elastic loop 101 is routed over the instep of the foot 41. The elastic loop 101 can at any time be easily repositioned longitudinally relative to shank body 58 by removing the ballet pointe shoe 20 from the foot 41 and manually adjusting its longitudinal position relative to ledge 115 of the shank body 58. An elastic loop 101 mounted in this manner is not only longitudinally repositionable but is also removable and/or replaceable with another elastic loop 101.

FIG. 25 shows an embodiment of a ballet pointe shoe with an insole 32 and shank body 58 whose ledge 115 temporarily manually separable from one another to a degree adequate to form between them a temporary gap 109 of sufficient size to permit elastic loop 101 to be longitudinally repositioned along shank body 58 and/or removed from the ballet pointe shoe 20 and/or replaced with another elastic loop 101. If desired, a replacement elastic loop 101 may be one whose width and/or opening size and/or thickness may differ from the width and/or opening size and/or thickness of an elastic loop 101 which it replaces. Alternatively or in addition to any such dimensional differences, a replacement elastic loop 101 may optionally be one whose spring constant differs from that of an elastic loop 101 which it replaces. An elastic loop 101 may be is selected from a set 110 of two or more the elastic loops 101, at least one the elastic loop 101 in the set 110 differing from at least one other the elastic loop 101 in the set 110 with respect to one or more of the following parameters: (i) unstretched width, W, (ii) unstretched inside circumference, (iii) unstretched thickness, T, and (iv) spring constant.

It is to be understood that elastic loop 101 may permissibly be, but need not necessarily be, formed entirely of a material which is elastically stretchable, that is, a material elongates elastically when a tensile force is applied but returns to substantially its original length after the tensile force is removed. In some embodiments, elastic loop 101 may include one or more segments which are not of an elastically stretchable material provided elastic loop 101 includes at least one segment which is elastically stretchable. In some embodiments elastic loop 101 may be formed entirely, or in part, of a material that consists of or includes a natural or synthetic rubber material. In some embodiments elastic loop 101 may be formed entirely, or in part, of a woven material in which fibers of one or more natural or synthetic materials such as cotton, nylon and/or rayon may be interwoven with rubber strips. While in some embodiments an optional elastic loop 101 may permissibly be of a material that comprises or consists of a natural and/or synthetic rubber material, or a material that includes natural and/or synthetic rubber, the term "elastic" is used herein in the sense of being elastically stretchable and is not to be construed as requiring or being limited to a rubber material, either natural or synthetic.

Referring additionally to FIG. 22, an elastic loop 101 may be selected from a set 110 which includes two or more elastic loops 101*a*, 101*b*, 101*c* through 101*n* which may differ from one another with respect to any one or more of the parameters which will now be described. For example, one or more elastic loops 101 in a set 110 may differ from one or more other elastic loops 101 in the same set 110 with respect to their unstretched inside circumference. As can be seen in FIG. 21 for example elastic loop 101*b* may have a smaller unstretched inside circumference, and thus a smaller unstretched foot opening size, than elastic loops 101*a* and/or 101*c* while an elastic loop 101*n* may have an unstretched inside circumference greater than that of elastic loops 101*a* and/or 101*c*. A Set 110 may include at least one elastic loop 101 having an unstretched inside circumference which may be greater than or less than the unstretched inside circumference of at least one other elastic loop 101 in the same set 110. In some embodiments, a set 110 may include at least one elastic loop 101 having an unstretched width, W1, which may be wider or narrower than the unstretched width, W2 of at least one other elastic loop 101*c* in the same set 110. One or more elastic loops 101 in a set 110 may differ from one or more other elastic loops 101 in the same set 110 with respect to their unstretched thickness, T, (i.e. the unstretched thickness of the material of which the loop 101 is formed). A ballet dancer may thus select whichever of the two or more elastic loops 101 in a set 110 the ballet dancer may find to be most comfortable or best suited to a particular purpose or personal preference.

According to some embodiments a set 110 may include at least one elastic loop 101 having a spring constant (k) which is greater than or less than the spring constant of at least one other elastic loop 101 in the same set 110. The term "spring constant" as used herein refers to the unit change in elastic force per change in unit length of elastic loop 101 as it is stretched. Thus, for a given length by which an elastic loop 101 may stretch during use, one or more of the elastic loops 101 in a set 110 may exert a higher or lower elastic force on the foot of a dancer than one or more other elastic loops 101 in the same set 110 thereby permitting a dancer to select from the set 110 whichever elastic loop 101 in the set 110 may provide a desired amount of elastic force.

In some embodiments, the lower portions 105*a*, 105*b* and side portions 106*a*. 106*b* of an elastic loop 101 may be mounted within upper 22 just to the inside of the lateral sides 30*a* and 30*b* in such a way that in use, the foot 41 of a dancer is subjected at all times to a compressive elastic force, not only at the instep where such compressive force may be applied to the foot 41 by the upper portion 103 of the loop 101, but also to a compressive force along both lateral sides of the foot 41 where such compressive force may be applied along both lateral sides of the foot 41 by the side portions 106*a*, 106*b* of the elastic loop 101. In certain embodiments, an elastic loop 101 may be mounted such that at least its lower portions 105*a*, 105*b* is/are positioned to continuously apply an elastic compressive force to at least a portion of the arch of the foot 41 of a dancer during use. In preferred embodiments, at least one of the lower portions 105*a* of elastic loop 101 is positioned to at least partially underlie the arch of the foot 41 during use as an aid to applying such compression. A conventional arch support of the type having a projecting arch support surface formed in an insole relies on gravity and the weight of the dancer to exert a supporting reaction force on the arch of the foot. However, elastic loop 101 may provide and/or increase, support at the arch and/or other portions of the sole of the dancer's foot 41 even at times when dancer may completely or partially airborne or otherwise positioned such that little, if any, support would be provided by a conventional arch support.

In some embodiments, an elastic loop 101 may be a continuous loop such as in the case of the examples 101*a*, 101*b*, 101*c* 101*n* shown in FIG. 22. Alternatively, an elastic loop 101 may be interrupted at one or more locations.

While some embodiments of a ballet pointe shoe 20 may be used during ballet performances and/or during ballet training with or without an elastic loop 101 installed, a ballet pointe shoe 20 having an elastic loop 101 installed is particularly useful during ballet training as the pressure exerted by the elastic loop 101 on the foot of the dancer provides tactile feedback which can assist the dancer in sensing that their foot 41 is properly centered within the toe box 53.

In interpreting the present disclosure and the claims, references of the form "A and/or B" encompass any and every combination and subcombination of elements A and B, namely, any or all of the following: (i.) A, (ii.) B, (iii.) A or B, and (iv.) A and B. References of the form "A, B, and/or C" likewise encompass any and every combination and subcombination of elements A, B and C). Where the present disclosure or any of the claims may recite "a" or "a first" item or the equivalent thereof, such disclosure includes one or more such items and does not require or exclude two or more such items. Numerical or ordinal terms such as "first", "second", "third" etc. when used to refer to items are used solely to identify the items, and do not require or limit the number of such items elements and do not indicate, require or limit a particular position or order of such items unless expressly and clearly stated otherwise.

Descriptions made with reference to "embodiment", "embodiments", "some embodiments", "an embodiment", "preferred embodiment", "other embodiments" "alternative embodiments", "various embodiments" or the like mean that the description is applicable to at least one embodiment of the invention but not necessarily all embodiments. The terms "comprising," "including," "having," and the like, as used with respect to one or more embodiments, are synonymous. In some cases features, items steps or other subject matter are described herein as being optional or using terms such as "optional" or "optionally". However, lack use of such terms in connection with the description of any other features, items steps or other subject matter does not in any way mean or imply that such other features, items steps or other subject matter are required or are not optional.

As an aid to understanding, various actions, operations or steps may sometimes be presented herein or described herein in sequence. However, the order of description or written presentation herein is not to be construed to mean or imply that such must necessarily occur in a corresponding order or sequence unless otherwise expressly and clearly stated or logically essential. Some actions, operations or steps may permissibly be performed in an order or sequence other than the order of their description or written presentation herein unless otherwise expressly and clearly stated or logically essential. Unless otherwise expressly and clearly stated or logically essential, actions, operations or steps described herein may be combined or divided. Unless otherwise expressly and clearly stated or logically essential, any description herein of any one or more actions, operations or steps does not preclude any one or more other preceding, succeeding and/or intervening actions, operations or steps irrespective of whether or not such preceding, succeeding and/or intervening actions, operations or steps are described or disclosed herein.

Unless otherwise expressly and clearly stated or logically essential, any illustration, description, or reference herein of any one or more items, structures or elements being "connected to", "coupled to", "joined to", "joined with", "attached to", "mounted to", "mounted in" or "secured to" any one or more other specified items, structures or elements shall not be construed to preclude such connection, coupling, joint, attachment, mounting or securement being either made indirectly, by way of one or more other specified or unspecified items structures or elements, or being made directly.

Unless otherwise expressly and clearly stated or logically essential, any illustration, description, or reference herein of any one or more items, structures or elements "adjoining", any one or more other specified items, structures or elements, shall be construed to permit that such may adjoin either direct or indirectly. The term "adjoining" permits, but does not require, preclude the presence of items, structures or elements interposed between those describes as adjoining. Unless otherwise expressly and clearly stated or logically essential, any illustration, description, or reference herein to any one or more items, structures or elements being "beneath", "below", "above", "behind", "in front of", "between", "under", "over", "in", "within", "outside", "inside" any one or more other specified items, structures or elements and/or any other prepositions or prepositional phrases shall construed in a manner which permits, but does not require, contact or immediacy and any and all other prepositions and or prepositional phrases shall be construed in that same manner.

As used herein, the term "material" encompasses, without limitation, unblended materials having a single constituent, blended materials having two or more constituents, composite materials, homogeneous materials and non-homogeneous materials.

While the invention has been described with reference to various preferred embodiments, it will be understood by those skilled in the art that various changes may be made and equivalents substituted for elements thereof without departing from the scope of the invention and that modifications may be made to adapt to a particular situation or application of the invention without departing from the scope of the invention. The invention is not limited to the particular embodiments disclosed. Rather, the invention covers all embodiments which are within the scope of the claims, either literally or under the Doctrine of Equivalents.

What is claimed is:

1. A ballet pointe shoe for use by a ballet dancer, said ballet pointe shoe comprising:

(a) an insole;

(b) an upper having a foot compartment and a throat by way of which a foot of the ballet dancer enters said foot compartment, said insole being disposed inside said foot compartment, said upper including a monolithic foot-supporting structure, the monolithic foot-supporting structure including (i) a toe box having a base, (ii) a shank body which extends longitudinally rearward from said base of said toe box, and (iii) a tunnel which penetrates said shank body and extends longitudinally through at least a portion of said shank body and into at least a portion of said base of said toe box, said tunnel having an open mouth disposed on said shank body, said open mouth being revealably concealed beneath said insole and being accessible by way of said throat and said foot compartment;

(c) an outsole disposed beneath said upper; and (d) a shank insert, a portion of said shank insert being removably and replaceably received in said tunnel when said shank insert is installed in said tunnel, said shank insert being removable from the ballet pointe shoe by withdrawing said portion of said shank insert from said tunnel by way of said open mouth of said tunnel and said throat of said upper, said shank insert being replaceable by inserting said portion of said shank insert into said tunnel by way of said throat of said upper and said open mouth of said tunnel.

2. The ballet pointe shoe as claimed in claim 1, wherein said shank insert is selected from a set of two or more shank inserts, at least one of said shank inserts in said set having a first flexural rigidity profile, at least one other of said shank inserts in said set having a second flexural rigidity profile which differs from said first flexural rigidity profile.

3. The ballet pointe shoe as claimed in claim 1, wherein said shank body includes a ledge which is disposed beneath said insole and which extends longitudinally rearward of said open mouth of said tunnel, and wherein said open mouth of said tunnel is revealably concealed beneath said ledge.

4. The ballet pointe shoe as claimed in claim 3, wherein said open mouth of said tunnel is revealably concealed beneath said ledge and said insole.

5. The ballet pointe shoe as claimed in claim 3, wherein said upper includes an inner liner and said ledge projects into said foot compartment interiorly of said inner liner.

6. The ballet pointe shoe as claimed in claim 5, wherein said open mouth of said tunnel is disposed interiorly of said inner liner.

7. The ballet pointe shoe as claimed in claim 1, further comprising an elastic loop mounted removably in said upper for continuously applying an elastic force between an instep portion of a foot of the ballet dancer and said shank body to continuously urge said shank body toward a sole of the foot of the ballet dancer during the use of the ballet pointe shoe, said elastic loop having an upper portion which, during said use, overlies an instep portion of a foot of a ballet dancer, said elastic loop having a lower portion which is routed beneath said shank body.

8. The ballet pointe shoe as claimed in claim 7, wherein said shank insert includes a rear portion and wherein said rear portion of said shank insert projects longitudinally rearward beyond said open mouth of said tunnel, and wherein said lower portion of said elastic loop is routed beneath said rear portion of said shank insert.

9. The ballet pointe shoe as claimed in claim 8, wherein said shank body includes a ledge which extends longitudinally rearward beyond said open mouth of said tunnel, and wherein said lower portion of said elastic loop is routed beneath said ledge.

10. The ballet pointe shoe as claimed in claim 9, wherein said lower portion of said elastic loop is releasably captured between said ledge and said rear portion of said shank insert.

11. The ballet pointe shoe as claimed in claim 1, wherein at least a portion of said shank insert is formed of a thermoplastic material and wherein said shank insert has an altered shape which differs from a previous shape of said shank insert and wherein said shank insert has been reshaped from said previous shape into said altered shape by heating at least said portion of said shank insert to a temperature at which at least said portion of said shank insert is in a softened state, said temperature being a temperature which is below a melting temperature of said thermoplastic material, applying a bending moment to said shank insert when at least said portion of said shank insert is in said softened state and lowering the temperature of at least said portion of said shank insert to a lower temperature at which said altered shape is retained even in the absence of said bending moment.

12. The ballet pointe shoe as claimed in claim 1, wherein at least a portion of said toe box is formed of a thermoplastic material and wherein said toe box can be reshaped into an altered shape which differs from a previous shape of said toe box by heating at least said portion of said toe box to a temperature at which at least said portion of said toe box is in a softened state, said temperature being a temperature which is below a melting temperature of said thermoplastic material, said heating being carried out by applying heat without removing said toe box from the ballet pointe shoe, applying a force to said toe box when at least said portion of said toe box is in said softened state to reshape said toe box from said previous shape into said altered shape and, lowering the temperature of at least said portion of said toe box to a lower temperature at which said altered shape is retained even in the absence of said force.

* * * * *